US006951148B2

(12) United States Patent
Battlogg

(10) Patent No.: US 6,951,148 B2
(45) Date of Patent: Oct. 4, 2005

(54) DEVICE FOR CONVERTING A ROTATIONAL MOVEMENT INTO A RECIPROCATING MOVEMENT

(76) Inventor: Stefan Battlogg, Haus NR. 166, A-6771 St. Anton/Montafon (AT)

( * ) Notice: Subject to any disclaimer, the term of this patent is extended or adjusted under 35 U.S.C. 154(b) by 0 days.

(21) Appl. No.: 10/772,183

(22) Filed: Feb. 4, 2004

(65) Prior Publication Data

US 2004/0154567 A1 Aug. 12, 2004

Related U.S. Application Data

(63) Continuation of application No. PCT/AT02/00096, filed on Mar. 28, 2002.

(30) Foreign Application Priority Data

Aug. 6, 2001 (AT) ..... A 1224/2001

(51) Int. Cl.[7] ..... F01L 1/34; F01L 1/30; F16H 21/16; F16H 25/08; F16H 53/00

(52) U.S. Cl. ..... 74/55; 74/25; 74/567; 74/569; 74/838; 123/90.16; 123/90.26

(58) Field of Search ..... 74/55, 25, 567, 74/568–5, 569, 337.5, 838; 123/570, 90.24, 123/90.26, 90.34, 90.52, 90.6, 90.15, 90.16, 123/90.17, 90.18

(56) References Cited

U.S. PATENT DOCUMENTS

| | | | | | |
|---|---|---|---|---|---|
| 1,493,419 | A | * | 5/1924 | Asbury | 123/79 R |
| 1,644,059 | A | * | 10/1927 | Holle | 123/90.26 |
| 1,869,919 | A | * | 8/1932 | Seabrook | 123/90.26 |
| 1,902,996 | A | * | 3/1933 | Gerard | 123/90.25 |
| 1,937,152 | A | * | 11/1933 | Junk | 74/569 |
| 2,858,818 | A | * | 11/1958 | Bailey | 123/90.25 |
| 4,036,185 | A | * | 7/1977 | Key | 123/90.25 |
| 4,200,081 | A | * | 4/1980 | Meyer et al. | 123/198 F |
| 4,711,202 | A | * | 12/1987 | Baker | 123/90.26 |
| 4,887,565 | A | * | 12/1989 | Bothwell | 123/90.26 |
| 5,058,540 | A | * | 10/1991 | Matsumoto | 123/90.17 |
| 5,090,366 | A | * | 2/1992 | Gondek | 123/90.17 |
| 5,125,372 | A | * | 6/1992 | Gondek | 123/90.17 |
| 5,931,130 | A | * | 8/1999 | Lucarini | 123/90.24 |
| 6,705,262 | B2 | * | 3/2004 | Battlogg | 123/90.26 |
| 6,796,277 | B2 | * | 9/2004 | Battlogg | 123/90.26 |
| 2002/0073947 | A1 | | 6/2002 | Battlogg | |
| 2002/0185092 | A1 | | 12/2002 | Battlogg | |

FOREIGN PATENT DOCUMENTS

| | | | |
|---|---|---|---|
| GB | 37 00 715 | A1 | 7/1987 |
| GB | 2207968 | A * | 2/1989 |
| WO | 98/26161 | | 6/1998 |
| WO | 01/12958 | A1 | 2/2001 |
| WO | 01/12959 | A1 | 2/2001 |
| WO | 03/104618 | A1 | 12/2003 |

* cited by examiner

*Primary Examiner*—David A. Bucci
*Assistant Examiner*—Colby Hansen
(74) *Attorney, Agent, or Firm*—Laurence A. Greenberg; Werner H. Stemer; Ralph E. Locher

(57) ABSTRACT

A device for transforming a rotational movement into a reciprocating to-and-fro movement has a cam element on a driven carrier shaft. The cam element has an eccentric control area, or lobe. A cam follower can be displaced or pivoted by the cam element. The cam element is rotationally mounted in a flexible encompassing element which is movably connected to the cam follower perpendicular to the axis of rotation of the cam element. The flexible encompassing element surrounds the eccentric control surface of the cam element and a non-driven bearing surface for the cam follower.

19 Claims, 19 Drawing Sheets

DEVICE FOR CONVERTING A ROTATIONAL MOVEMENT INTO A RECIPROCATING MOVEMENT

CROSS-REFERENCE TO RELATED APPLICATION

This application is a continuation, under 35 U.S.C. § 120, of copending International Application No. PCT/AT02/00096, filed Mar. 28, 2002, which designated the United States. The application also claims the benefit, under 35 U.S.C. § 119, of Austrian patent application A 1224/2001, filed Aug. 6, 2001; the entire disclosure of the priority application is herewith incorporated by reference.

BACKGROUND OF THE INVENTION

1. Field of the Invention

The invention relates to a device for converting a rotational movement into a reciprocating movement, in particular cam control, valve timing gear for internal combustion engines of motor vehicles or the like. The device has at least one cam element which is disposed on a driven support shaft and has an eccentric control surface and having a cam follower element, in particular a valve tappet or the like, which can be displaced or pivoted by the cam element. The cam element is rotatably disposed in a flexible enclosing element which is connected to one end of the cam follower element in a manner enabling it to move in a plane which is perpendicular with respect to the axis of rotation of the cam element.

Since customary valves of internal combustion engines require, for them to be closed, restoring springs which have to apply considerable forces, constrained guides have also already been proposed, these requiring weaker restoring springs or rendering them superfluous. One particular embodiment of a constrained guide of this type can be found, for example, in German published patent application DE 37 00 715 A1. There, the cam element is surrounded in a loosely adjacent manner by a flexible enclosing element that is connected to the valve actuating element. The cam element therefore revolves in the enclosing element.

I have previously described various developments of the foregoing type of constrained guide. See, for example, my international publications WO 01/12958 A (US 2002/0073947 A1) and WO 01/12959 A (US 2002/0185092 A1). When these enclosing elements are used, friction occurs between the circumferential surface of the cam element and the inner surface of the enclosing element, and it has therefore also been proposed to insert a friction-reducing medium between the circumferential surface of the cam element and the enclosing element via radial ducts in the cam element.

Since the enclosing element is subjected to relatively high tensile forces by the reciprocating cam follower element particularly when the push-off acceleration is braked, that part of the enclosing element which lies opposite the connecting region is pressed fixedly against the circumference of the cam element. Conversely, that part of the enclosing element which encloses the connecting region is exposed, shortly before it returns into the starting position, to correspondingly high compressive forces, since the restoring acceleration is braked, and is pressed onto the circumference of the cam element. In both cases, outlet openings situated in these regions are tightly closed by the enclosing element, and a very high pressure would be required to feed in the lubricating medium. For example, there is a pressure of 2 to 5 bar in conventional cylinder heads, and at least 10 times the pressure would have to be able to be applied in order to push the enclosing element away from the circumference and to allow the medium to emerge. (The values of this example relate to lubrications using oil). Only partial lubricant films are produced, and a mixed friction occurs, the coefficient of friction of which is not smaller than 0.1.

SUMMARY OF THE INVENTION

It is accordingly an object of the invention to provide a novel device for converting a rotational movement to a reciprocating movement, which overcomes the above-mentioned disadvantages of the heretofore-known devices and methods of this general type and which, specifically, substantially improves the frictional ratios in a device of the above-mentioned type.

With the foregoing and other objects in view there is provided, in accordance with the invention, a device for converting a rotational movement into a reciprocating movement, such as a cam control device, or a drive for a valve tappet of valve in an internal combustion engine of a motor vehicle. The device comprises:

at least one cam element mounted on a driven support shaft for rotation about an axis of rotation, the cam element having an eccentric control surface driven by the support shaft;

a cam follower element mounted for displacement or pivoting by the cam element and for bearing on a non-driven bearing surface;

a flexible enclosing element connected to the cam follower element, the flexible enclosing element enclosing the cam element while allowing the cam element to rotate therein, the flexible enclosing element moving in a plane perpendicular to the axis of rotation of the cam element and surrounding the eccentric control surface of the cam element and the non-driven bearing surface for the cam follower element.

In other words, the objects are achieved by the fact that the flexible enclosing element surrounds the eccentric control surface of the cam element and a nondriven bearing surface for the cam follower element. A nondriven bearing surface is understood above all to mean a cylindrical bearing surface fixed on the device, for example a bearing surface on a bearing element of the support shaft. This enables, depending on the shape of the cam, the contact surface, which produces a substantial part of the friction, between the cam element and the enclosing element to be reduced in length by at least one third, even by up to two thirds in the case of conventional cam shapes. Since the cam element is additionally also narrower than the enclosing element—at least on one side, preferably on both sides, the cam element is adjoined by an, in particular a cylindrical end region of a bearing element—the contact surface producing friction is also narrower than in conventional designs.

However, the nondriven bearing surface may also be formed on a ring or the like mounted rotatably on the bearing element, for example, so that minimal revolving of the bearing surface is possible, this arising owing to the slightly alternating and changing geometrical ratios between the connecting point of the enclosing element with the cam element and the migrating control surface.

As previously described in my earlier international PCT publication WO 98/26 161 A, it is possible to divide the control cam region into two components, namely into the cam element and a bearing element. This takes place there, however, owing to reasons concerned with easier manufacturing and setting of the closing position stop, since machining of the base circle of a cam element is not required.

Further friction-reducing measures may comprise the placement of roller bearings between each bearing element and the support shaft and/or the cam element, and/or the mounting of a rotatably mounted roller in the eccentric control surface of the cam element and/or the formation of feed ducts for feeding a friction-reducing medium, in particular lubricating oil, to the contact surfaces producing friction.

In the above-mentioned cases, in which high tensile or compressive forces occur, the forces are transmitted by the design according to the invention directly to the bearing elements, so that the sliding or rolling bearings between the bearing elements and the support shaft are relieved of load. In order to relieve the mounting of the cam follower element of load, provision is made, in a further preferred embodiment, for that end of the cam follower element which is connected to the enclosing element to be guided in a guide which is fixed on the device.

The reduction in size of the friction-producing contact surfaces furthermore reduces the quantity of heat which arises, the dissipation of which is facilitated if the upright base circle region is part of the camshaft bearing and can be connected directly to the housing, in particular the cylinder head, and reduces the requirement for lubricant. The preferably cylindrical bearing surface may furthermore also have a central flat point from which the enclosing element is slightly spaced apart, so that a heat-induced compensation of play for the cam follower element is also provided in a simple manner. The cam element is restricted to the eccentric region, i.e. the customary base circle region is only formed in part, if at all.

The constrained guidance of the cam follower element renders the customary, solid restoring springs, which have to have, for example, conventional valve timing gears, superfluous. Nevertheless, a small restoring spring may be advantageous. In one preferred embodiment, in which the cam follower element is articulated on the enclosing element by means of a bearing pin, the restoring force can act on the bearing pin by the bearing pin being pressed against the bearing surface, which is fixed on the device, by an elastic element. In order to produce the restoring force, use may be made, for example, of a leg spring or the like which is supported, on the one hand, on the bearing pin, and on the other hand, on the bearing element or the like. One preferred embodiment makes provision for the bearing pin to have at least one exposed end region, and for an elastically flexible strip of steel, rubber or the like to be guided around the exposed end region and the bearing element.

The device according to the invention therefore contains at least two constrained strips or loops, namely the extension-resistant enclosing element for the constrained guidance of the cam follower element and the elastic strip for resetting the cam follower element.

In a further preferred embodiment, the enclosing element is also formed by an elastic strip which is preferably provided with an elongation limit and interacts with a radially retractable and extendable cam element on the support shaft in order to change the size of the cam stroke. In the case of valve timing gears, devices of this type are also referred to as variable valve operating mechanisms, it being possible for the radial displaceability of the cam element to be obtained by rising control surfaces which are provided between the cam element and the driven support shaft, if the support shaft is, for example, axially displaceable, or are provided between the cam element and a control shaft which are arranged rotatably in the hollow-cylindrical support shaft. In a further embodiment, the cam element may also be guided in a constrained manner, for example by a crank mechanism or the like.

Other features which are considered as characteristic for the invention are set forth in the appended claims.

Although the invention is illustrated and described herein as embodied in a device for converting a rotational movement into a reciprocating movement, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
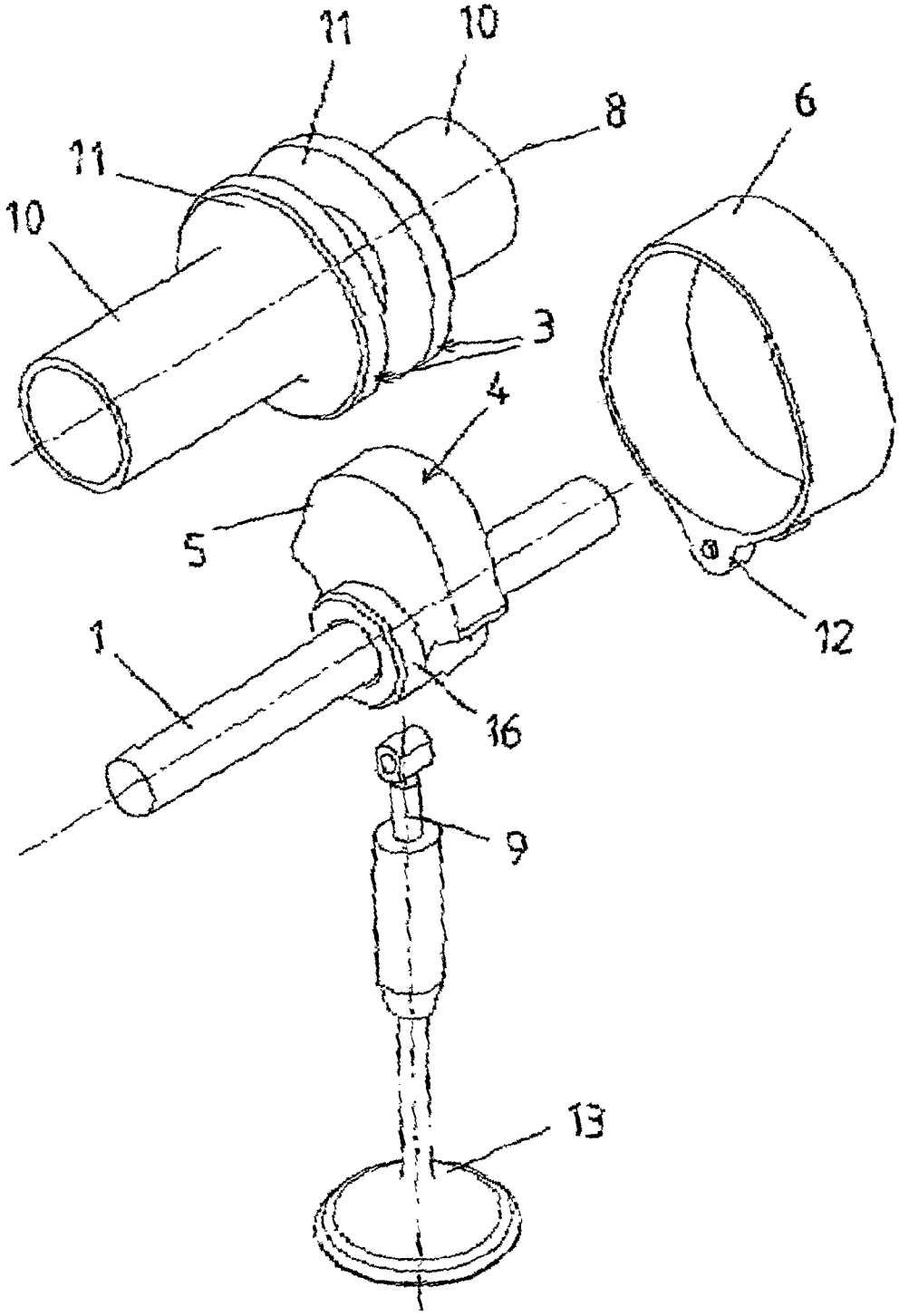
FIG. 1 shows an exploded illustration of the individual components of a first embodiment of a device according to the invention.
Figure 2:
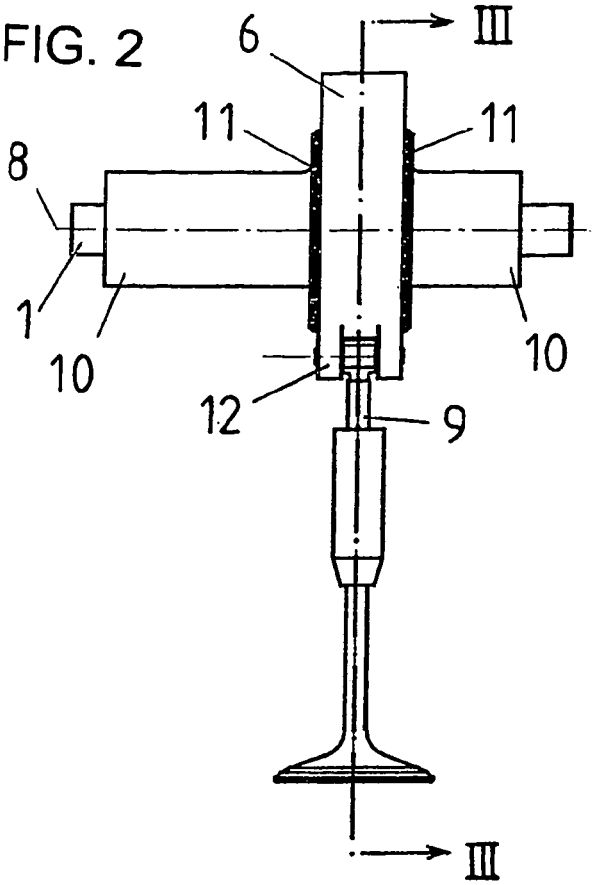
FIG. 2 shows a side view.
Figure 3:
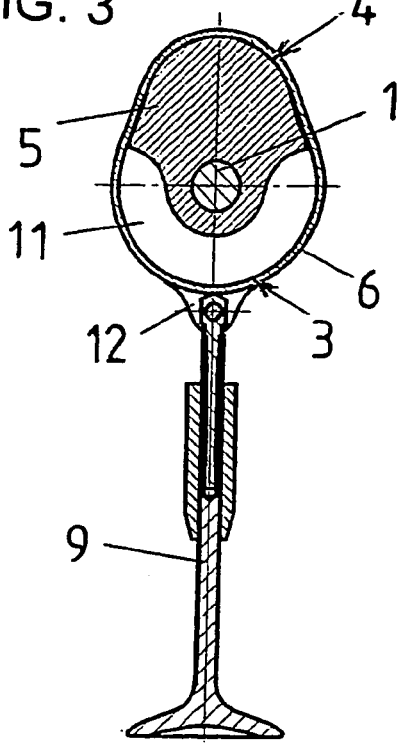
FIG. 3 shows a section according to the line III—III of FIG. 2.
Figure 4:
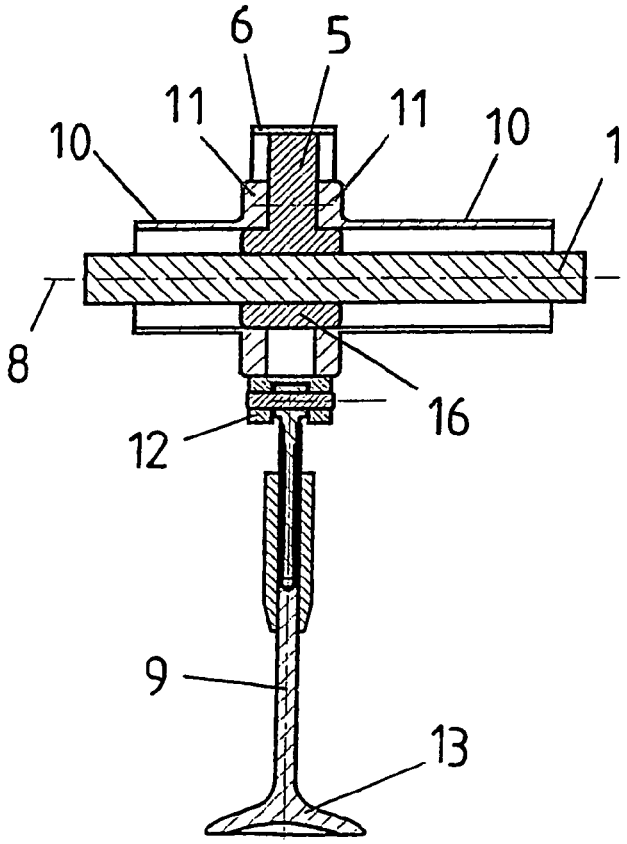
FIG. 4 shows a longitudinal section through the first embodiment.
Figure 5:
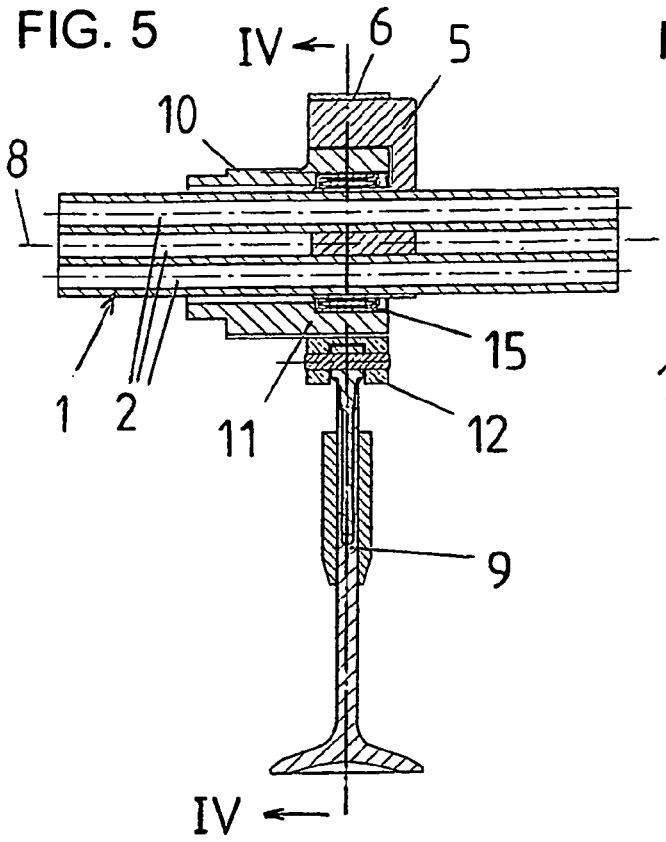
FIG. 5 shows a longitudinal section through a second embodiment of a device according to the invention.
Figure 6:
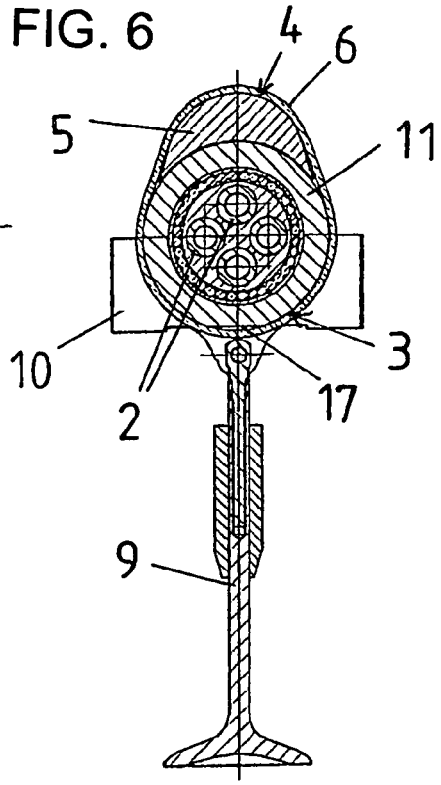
FIG. 6 shows a section according to the line VI—VI of FIG. 5.

Referring now to the figures of the drawing in detail and first, particularly, to FIG. 1 thereof, there is shown a device according to the invention for converting a rotational movement into a reciprocating, rectilinear, to-and-fro, or pivoting movement. The exemplary device comprises a driven support shaft 1 on which a cam element 5 having an eccentric control surface 4 is fixed. The eccentric control surface 4, also referred to as cam lobe and cam valley surface, enables a cam follower element 9, which is held in a bearing manner against it, to be moved in a reciprocating manner in accordance with its guide or mounting. In all of the exemplary embodiments, the preferred use of the device is shown, namely as a valve operating mechanism of internal combustion engines. However, devices of this type may also be used, for example, in cam controls of machine tools, in particular gears or the like, in which case the cam follower element 9, which forms a valve tappet in the exemplary embodiments shown, is designed in accordance with the use.

A central, hub-like region 16 of the cam element 5 is rotatably mounted on one or both sides on or in a bearing element 10, on which an annular or sleeve-shaped end region 11 having an in particular cylindrical outer surface is formed. A flexible surround element, or enclosing element 6, for example a fabric strip or the like, surrounds the eccentric control surface 4 of the cam element 5 and the outer surface of the end region 11 of each bearing element 10, and has a holder 12 on which the cam follower element 9 is arranged in an articulated manner. The axis of articulation runs parallel to the axis of rotation 8 of the support shaft 1. The rotation of the cam element 5 results in an oscillating movement of the enclosing element but the latter, owing to its connection to the cam follower element 9, is not able to rotate but rather is lifted up continuously all around from the outer surface of the end region 11. In the process, the cam follower element 9 is transferred from a bearing surface 3, in which the cam follower element 9 is at the shortest distance from the axis of rotation 8, and which forms part of the outer surface of the end region 11, into a position at maximum distance from the axis of rotation 8, if the maximum amount of the eccentric control surface 4 of the cam element 5 is effective, and, on further rotation, is pulled back into the basic position again. In the case of the valve timing gear, the closed position is therefore the basic position and the position at maximum distance is the open position of the valve disk 13.

Figure 8:
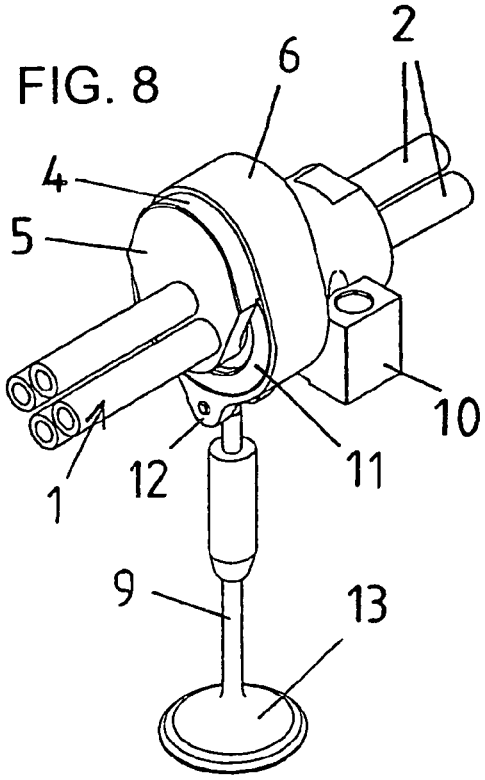
FIG. 8 shows an oblique view of the second embodiment.

FIGS. 1 to 4 show a first embodiment in which the bearing elements 10 are only shown schematically in the form of a length of casing pipe with rings on the end sides which are fixed, for example, in securing means 6 on the housing or—as FIG. 8 shows—are provided with corresponding fastening parts. The cam element 5 has a cam region which bears the eccentric control surface 4 and the axial extent of which around the two annular end regions 11 of the bearing elements 10 is shorter than its central region 16, which is fixed on the support shaft. The enclosing element 6 is approximately of a width which corresponds to the axial extent of the central cam region 16, so that the enclosing element 6 surrounds part of the cylindrical circumferential surface of the two end regions 11 and the eccentric control surface 4 of the cam element 5. Since only the eccentric control surface 4 has to slide along the inner surface of the enclosing element 6, the friction-producing contact surface is smaller than half of the inner surface of the enclosing element 6. As already mentioned, the latter is connected in an articulated manner via its holder 12 to the cam follower element 9, so that friction does not occur between the enclosing element 6 and the cylindrical outer surface, which serves as a bearing surface 3, of the two end regions 11 which are fixed on the housing as parts of the bearing elements 10. The division into contact surfaces with friction and those without friction can readily be seen in particular in FIG. 3, in which the cam element 5 having the eccentric control surface 4 can be seen cutaway, and, in contrast, the axially offset end region can be seen in plan view.

Figure 7:
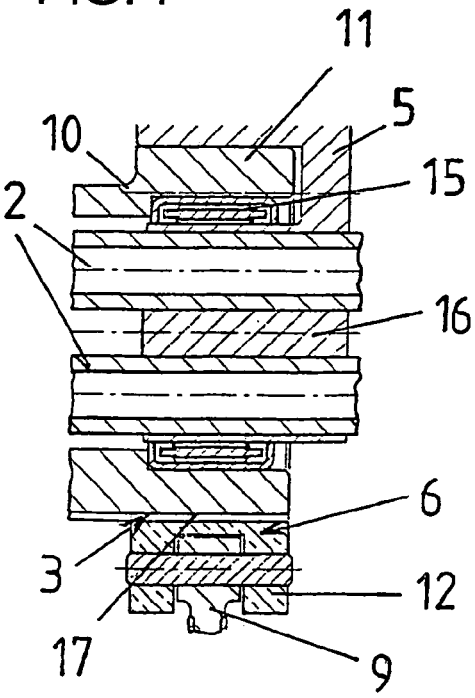
FIG. 7 shows, on an enlarged scale, the control cam region of FIG. 5.

In the embodiment according to FIGS. 5 to 8, the support shaft is formed by a bundle of supporting rods 2, thereby providing a simple, form-fitting connection between the support shaft 1 and the cam element 5. The support shaft 1 is driven via a drive wheel (not shown) which, like the cam element 5, has a corresponding pattern of holes in the center. The cam element 5 has a lateral annular groove in which the end region 11 of a bearing element 10 engages. A rolling bearing 15, for example a needle bearing or the like, is inserted between the core region 16, as FIG. 7 shows on an enlarged scale. Owing to the intermeshing of the end region 11 and of the cam element 10, the enclosing element 6 bears over its entire width against the bearing surface 3 of the end region 11 and surrounds the eccentric control region 4 of the cam element 5. As can be seen from the enlarged illustration of FIG. 7, the bearing surface 3 can have a central flattened section 17, so that compensation of play, for example in the case of heat-induced changes in length of the cam follower element 9, is possible. The oblique view of FIG. 8 shows the embodiment from the side which faces away from the bearing element 10.

Figure 9:
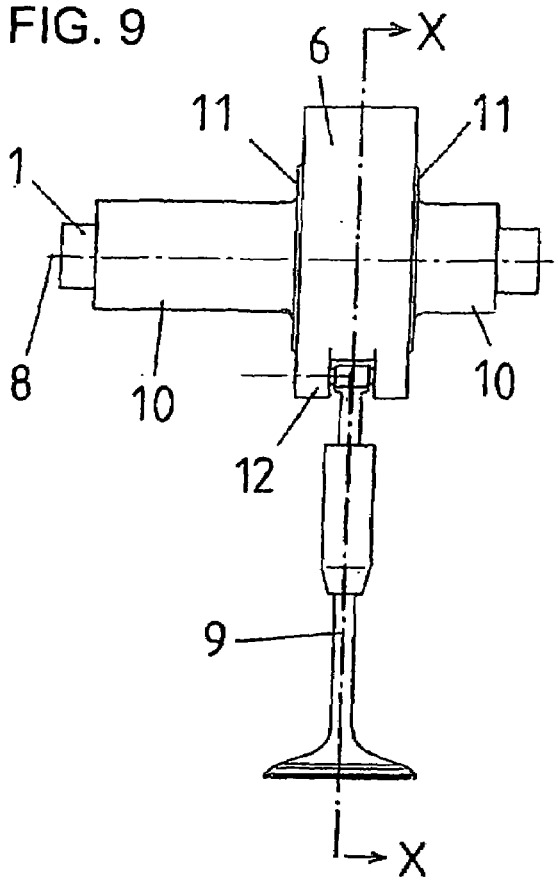
FIG. 9 shows a side view of a third embodiment of the device according to the invention.
Figure 10:
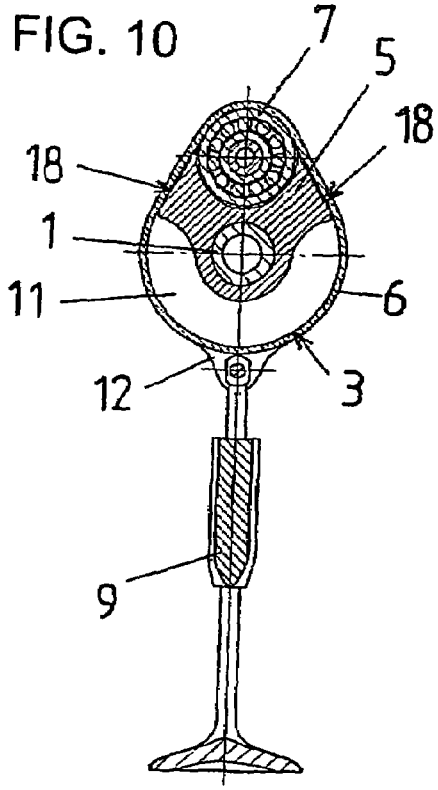
FIG. 10 shows a section according to the line X—X of FIG. 9.
Figure 11:
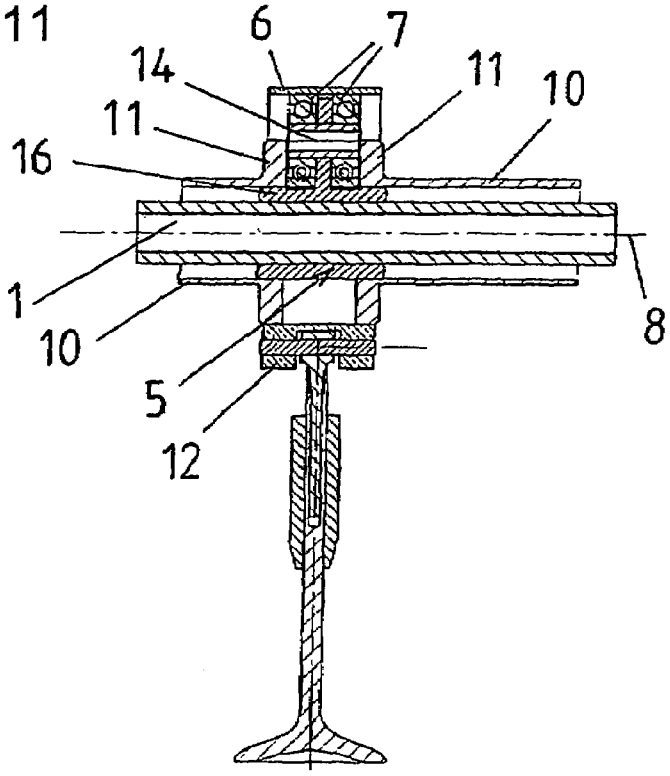
FIG. 11 shows a longitudinal section through the third embodiment according to FIG. 9.

In the embodiment according to FIGS. 9 to 11, which largely corresponds to the embodiment according to FIGS. 1 to 4, two recesses are formed in the cam element 5 and the remaining central web accommodates a pin 14 on which one roller 7 per recess is mounted rotatably by means of a rolling bearing, the arrangement and the cam shape being selected in such a manner that the circumferential surface of the two rollers 7 drop into the central region of the eccentric control surface 4. As is apparent in particular from FIG. 10, on both sides of the rollers 7 there remains only a short transition section 18 in which the circumferential surface of the cam element 5 comes into contact with the enclosing element 6. Since, during rotation of the cam element 5, the rollers 7 roll in the enclosing element 5, the friction-producing contact surfaces are once again substantially reduced. Of course, the installation of a rolling bearing 15 between the support shaft 1 and the core region 16 of the cam element 5 is also possible in this embodiment.

Figure 12:
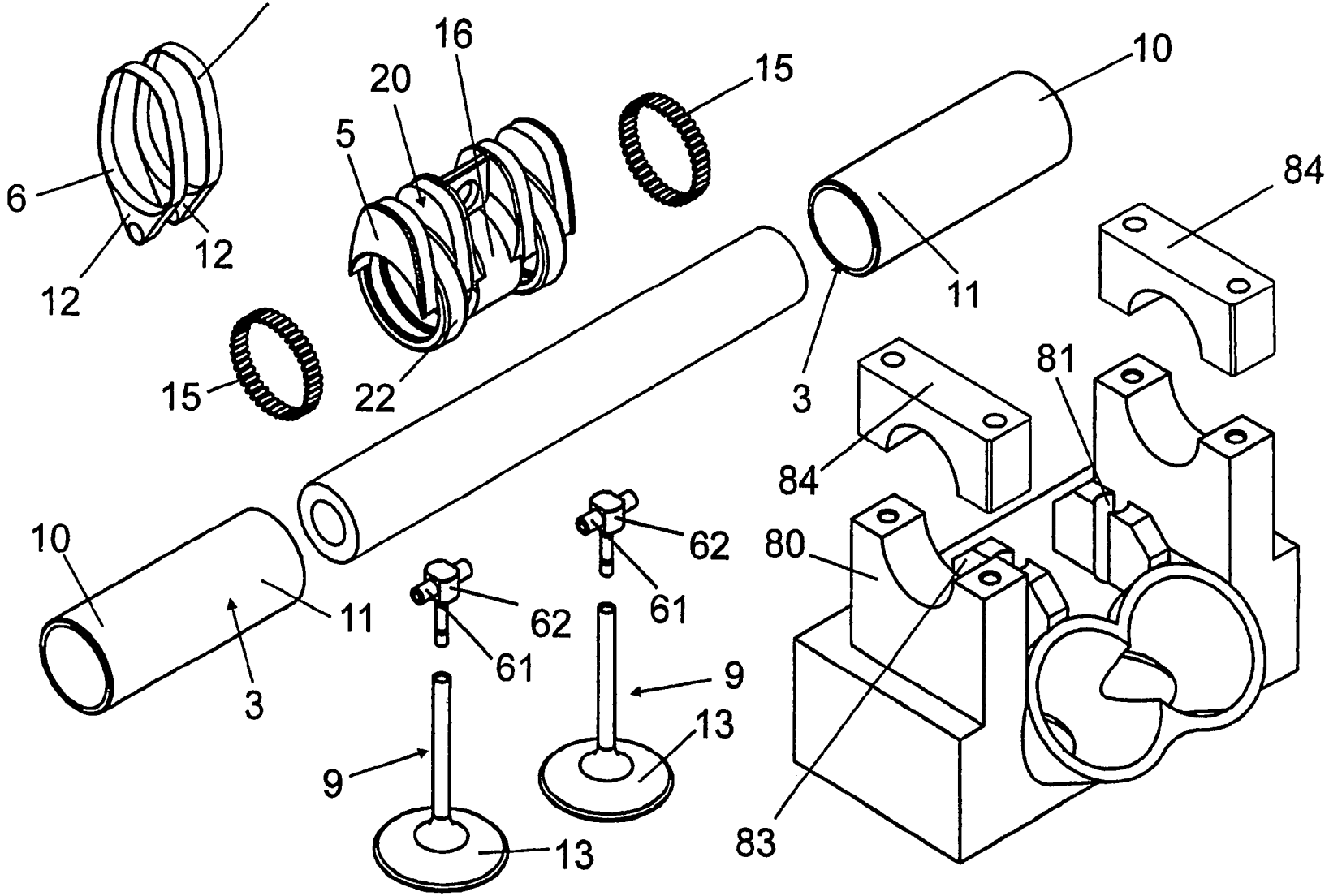
FIG. 12 shows an exploded illustration of the individual components of a fourth embodiment of the device according to the invention.
Figure 13:
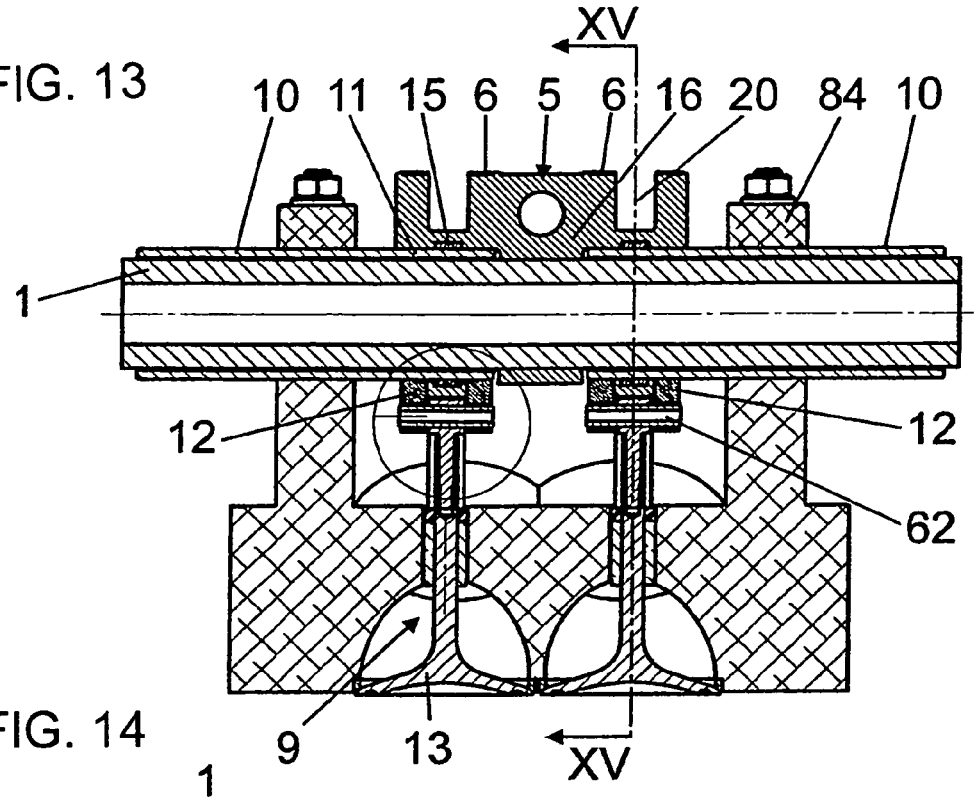
FIG. 13 shows a longitudinal section through the fourth embodiment, FIG. 14 and FIG. 16 each show, on an enlarged scale, the connecting region between the enclosing element and the cam following element.
Figure 14:
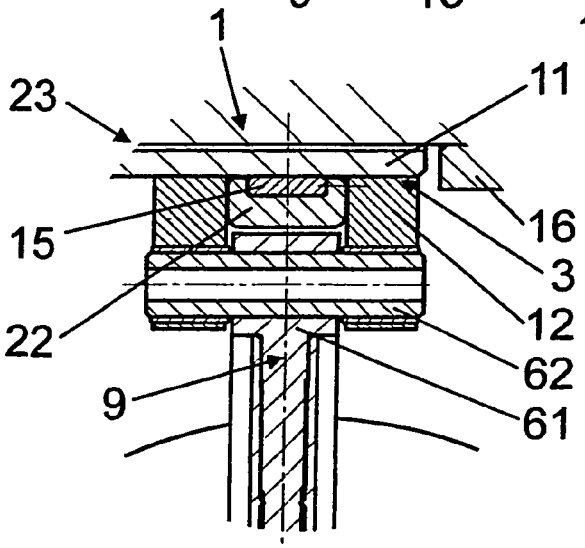
Figure 15:
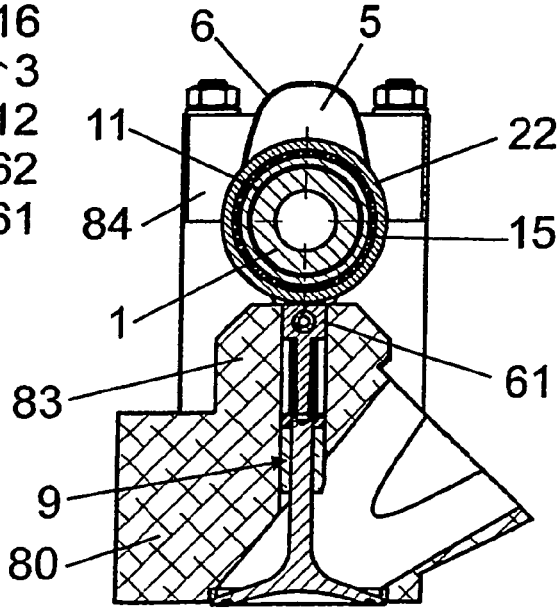
FIG. 15 shows a section according to the line XV—XV of FIG. 13.
Figure 16:
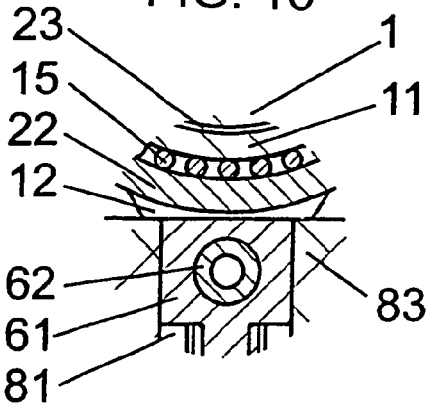

FIGS. 12 to 16 show an embodiment in which two cam elements 5 having a common central region 16 are formed, each cam element 5 having a radial recess 20 and forming a complete ring 22 in this region. The central region 16 of the cam element 5 is connected in a rotationally fixed manner to the support shaft 1, and the two rings 22, which each accommodate a rolling bearing 15, are mounted rotatably on the two tubular bearing elements 10. As is apparent from FIG. 14 or 16, an annular gap 23 remains between the support shaft 1 and the bearing elements 10, so that production inaccuracies in the support shaft 1 do not require any further processing. The recess 20 leaves a clearance for a guide sleeve 81 which is raised between the enclosing element 6 and the cam follower element 9 as far as the holder 12, is restricted at two mutually diametrically opposite webs 83 of the cylinder head 80 and the width of which corresponds to the recess 20. The two parts of the rotating cam element 5 rotate past on both sides of the raised guide sleeve 81 for the cam follower element 9. In this embodiment, the enclosing element 6 is provided with a central cutout which corresponds with the recess 20 or, as FIG. 12 shows, is formed from two loops which are held together by the holder 12 or by the bearing pin 62 of the tappet head 61. The cam element 5 may have an edge shoulder in order to avoid the enclosing element 6 slipping. The bearing elements 10 are fixed on protruding webs of the cylinder head 80 by means of holding-down devices 84.

FIGS. 17 to 24 illustrate an embodiment in which a common cam element 5 is assigned to two cam follower elements 9. The cam element 5 which is shown in oblique view in FIG. 17 therefore has a ring 22 at each end and a central region 16 with a five-sided opening. The cam element 5 is arranged in a rotationally fixed manner on a five-sided support shaft 1 which is mounted via the bearing elements 10 and via rings which are arranged fixedly or loosely on the end regions 11 of the bearing elements and on which the two rings 22 of the cam element 5 are mounted rotatably, in each case by means of a rolling bearing 15.

The enclosing element 6 does not have any cutouts and has, in the holder 12, a plug-in opening which is formed in a sleeve 19 and into which a bearing pin 62 is inserted, the bearing pin protruding on both sides and being connected at each end to a tappet head 61. In this embodiment too, the guide 81 for each cam follower element 9 is raised to reach the bearing sleeve 10.

Figure 21:
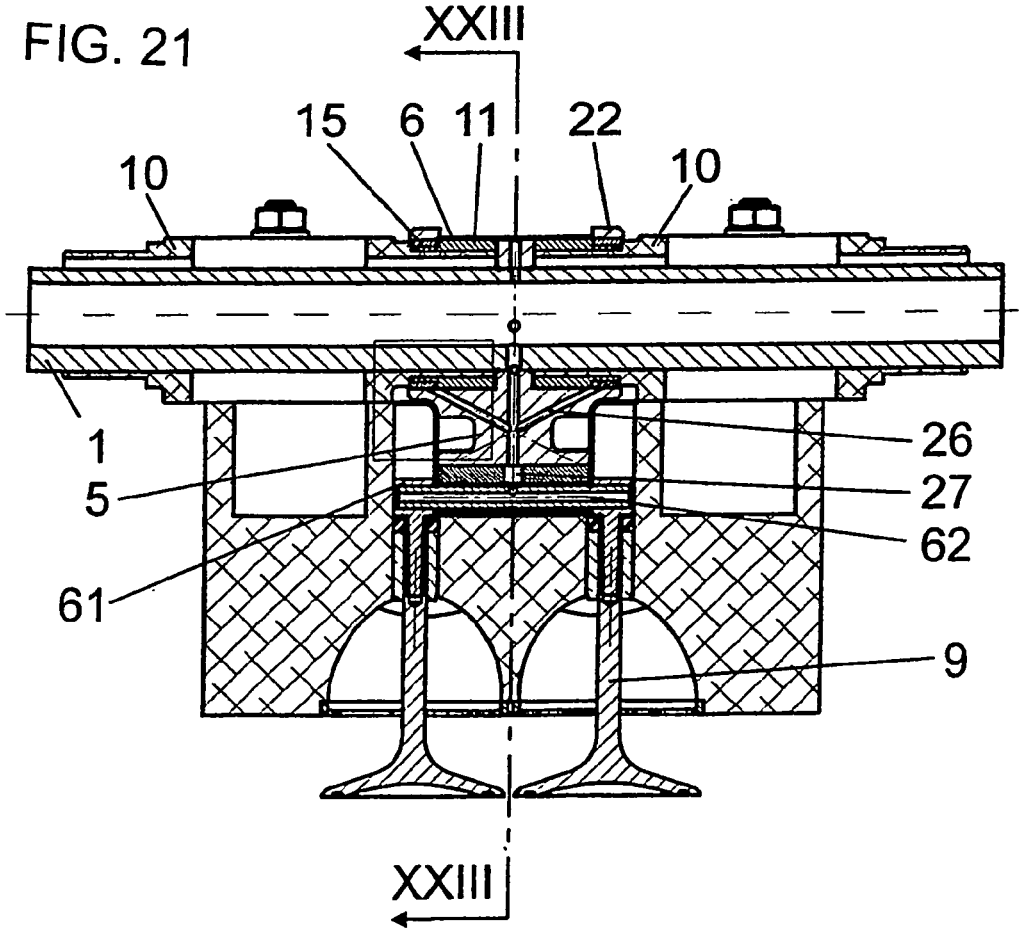
FIG. 21 shows a longitudinal section similar to FIG. 18, in which the cam element is rotated through 180°.
Figure 23:
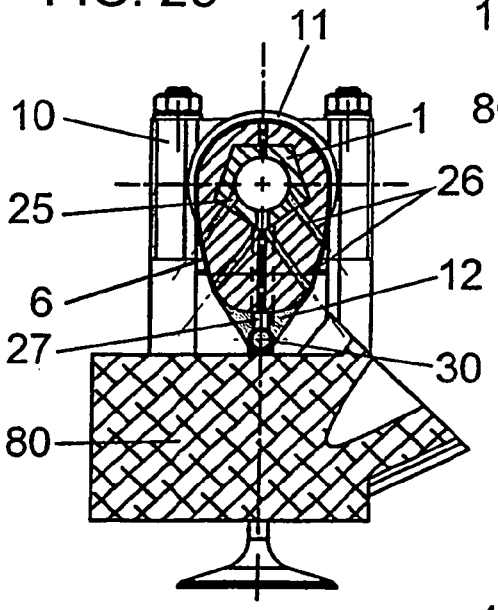
FIG. 23 shows a section according to the line XXIII—XXIII of FIG. 22.
Figure 24:
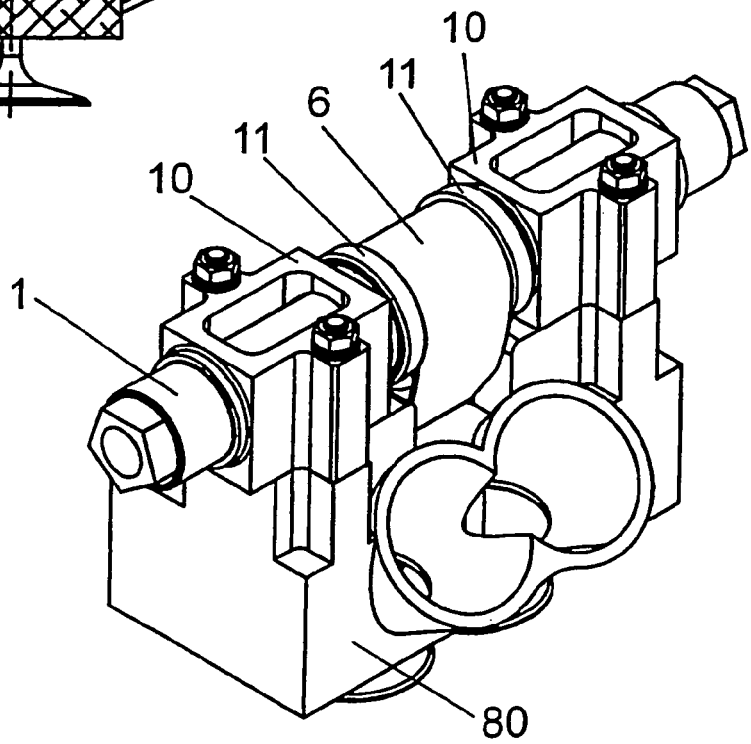
FIG. 24 shows a schematic oblique view of the device.

The clearance between the two guides 81 is of such a size that the cam element 5 can spin around, FIGS. 21 and 23 showing that position in which the valve disk 13 is open the greatest distance away from the valve seat.

Figure 22:
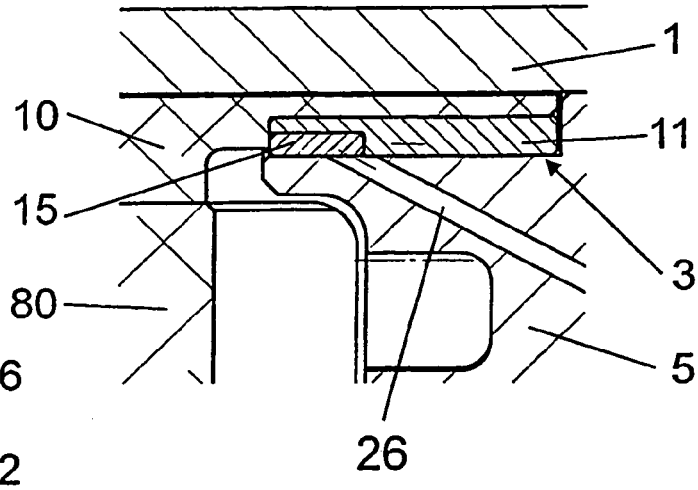
FIG. 22 shows, on an enlarged scale, the bearing region of the cam element from FIG. 21.

This embodiment also shows a possibility for feeding a friction-reducing medium, for example lubricating oil, to the individual bearing surfaces. For this purpose, the support shaft 1 has a central feed duct and radial outlet openings 25 which merge into holes 26 of the cam element 5. The holes 26 open into the contact surface with the enclosing element 6 on the circumference of the cam element 5 and in the region of the rolling bearings 15 (FIG. 22). A continuing hole 27 extends through the holder 12 to a hole 28 in the sleeve 19, in which the bearing pin 32 having a circumferential groove 29 is arranged. The bearing pin 62 is provided with an axial duct 30 which is connected to the circumferential groove 29 by a hole (not designated). The medium emerging from the duct 30 is distributed over the sliding surfaces of the guide sleeves 81 for the tappet head 62.

FIGS. 25 to 31 show a sixth exemplary embodiment in which two cam elements 5 are again provided on the central region 16, said cam elements being surrounded by a common enclosing element 6. The central region 16 is provided with a noncircular hole 21 and is arranged in a rotationally fixed manner on the support shaft 1, the cross-section shape of which is composed from three more sharply curved arcs and three less sharply curved arcs which alternate with one another. Two cylindrical extensions which have outer bearing surfaces are formed on the central region 16 and are mounted inside two sleeve-shaped bearing elements 10. The bearing sleeves 10 are each fixed in two closed bearing rings 85 of the cylinder block 80, on which, in turn, raised guide sleeves 81 are provided.

Figure 17:
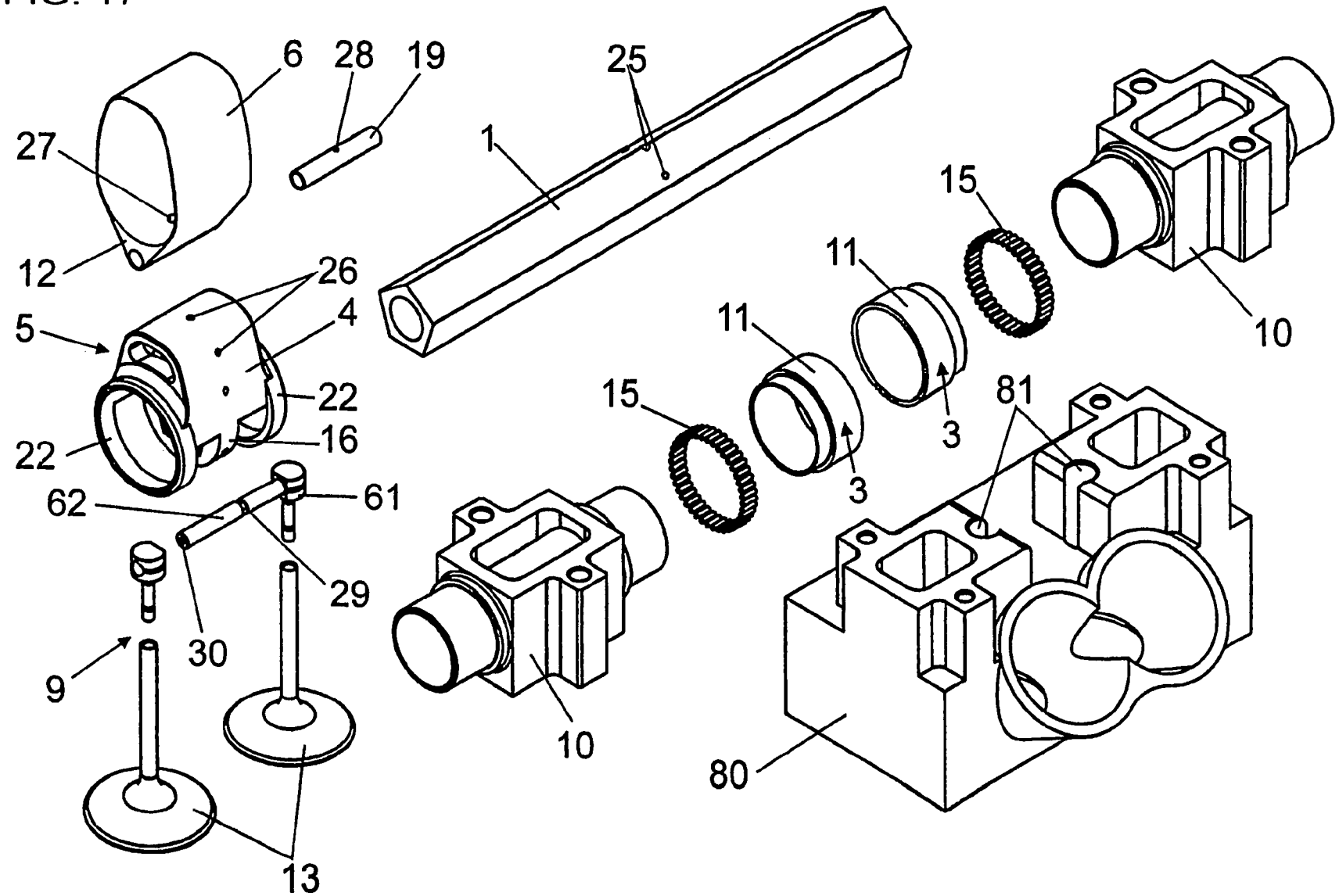
FIG. 17 shows an exploded illustration of the individual components of a fifth embodiment of the device according to the invention.
Figure 18:
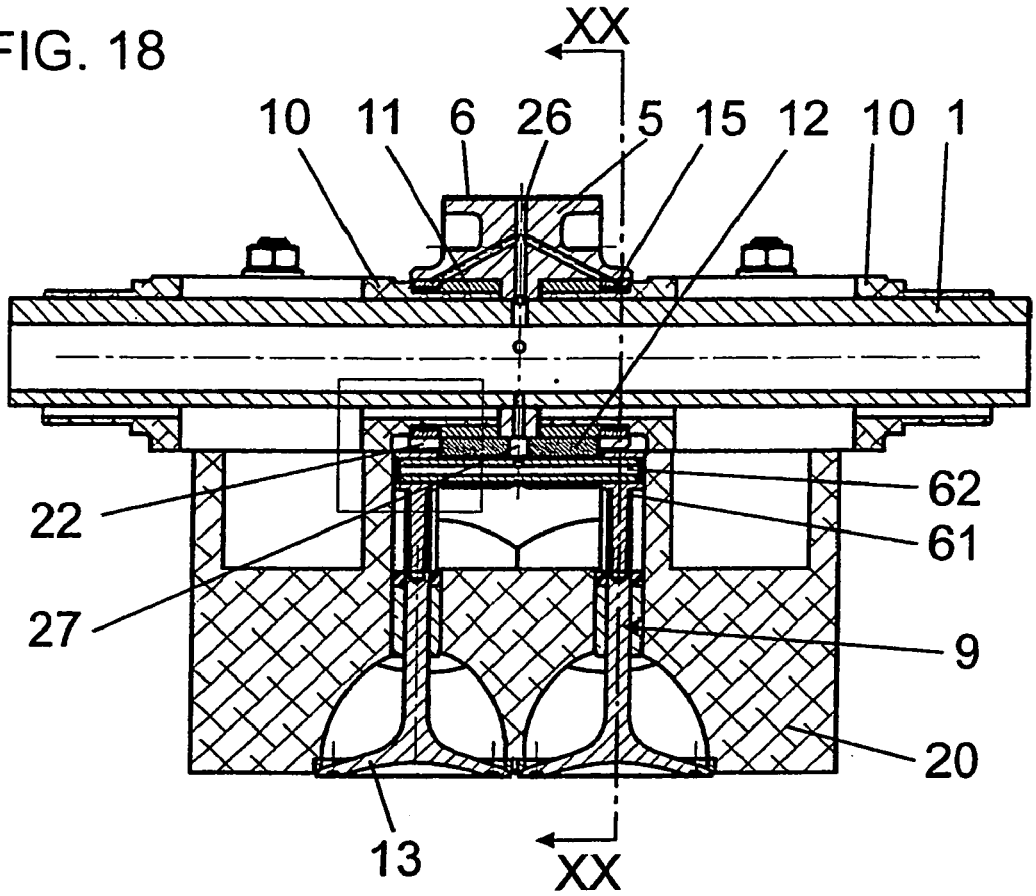
FIG. 18 shows the longitudinal section through the fifth embodiment, the cam follower element bearing against the bearing surface.
Figure 19:
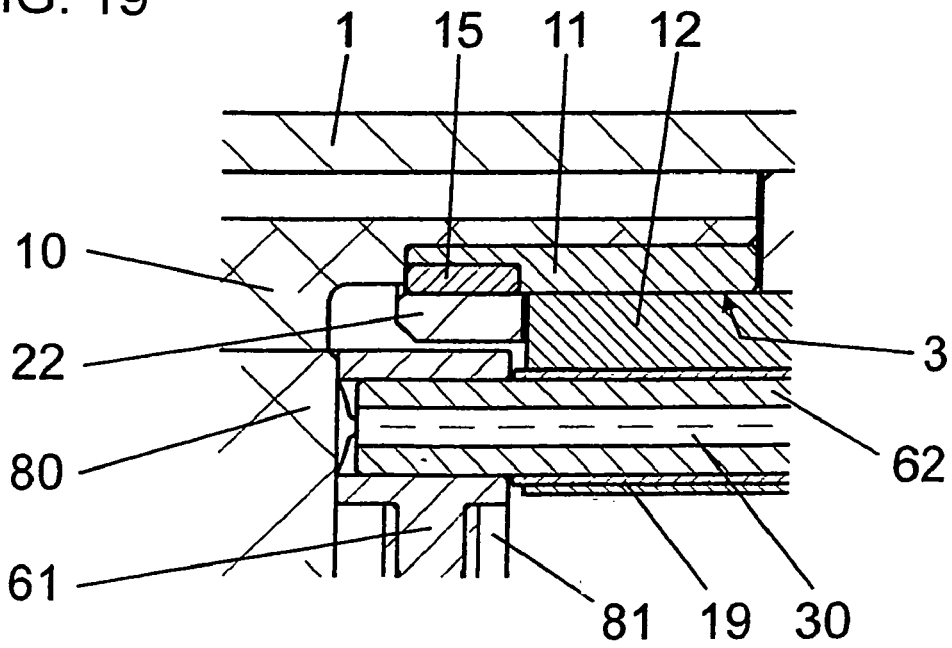
FIG. 19 shows, on an enlarged scale, the connecting region between the enclosing element and the follower element.
Figure 20:
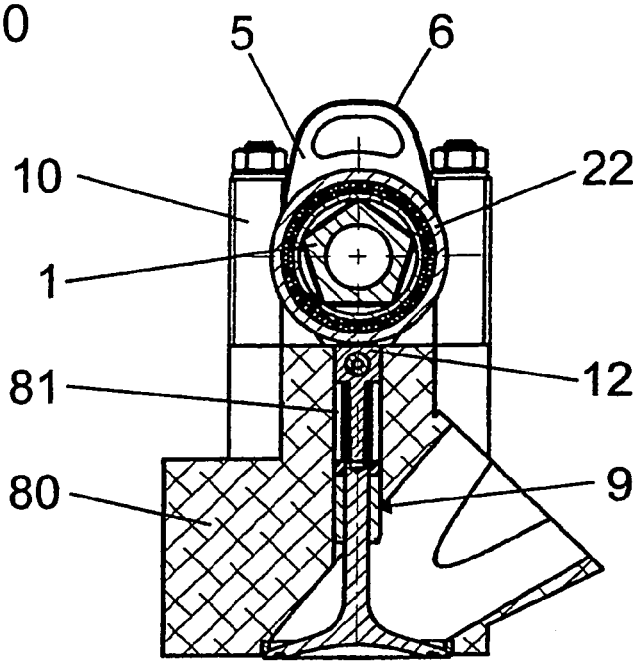
FIG. 20 shows a section according to the line XX—XX of FIG. 18.
Figure 27:
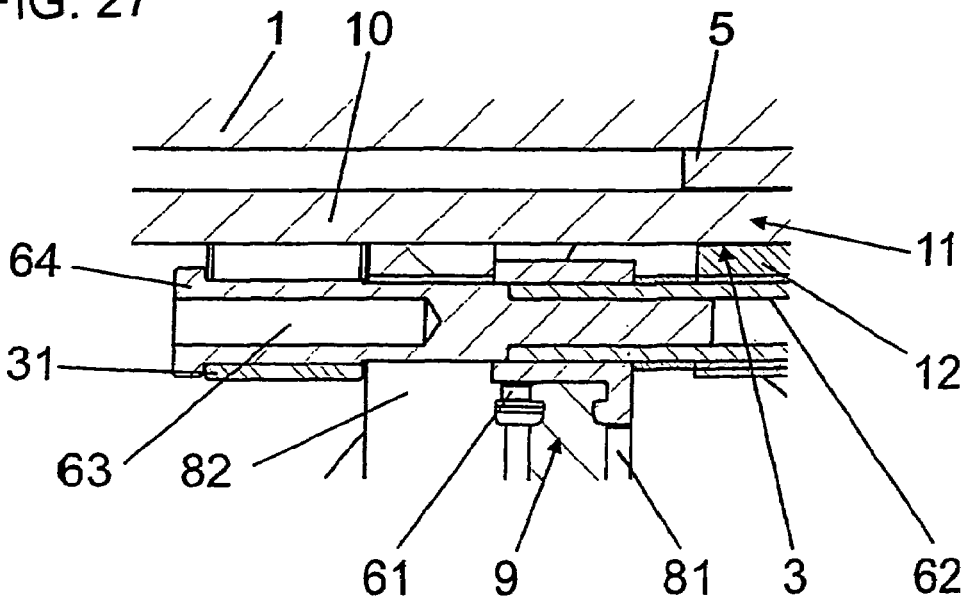
FIG. 27 shows, on an enlarged scale, the connecting region between the enclosing element and the cam follower element.
Figure 28:
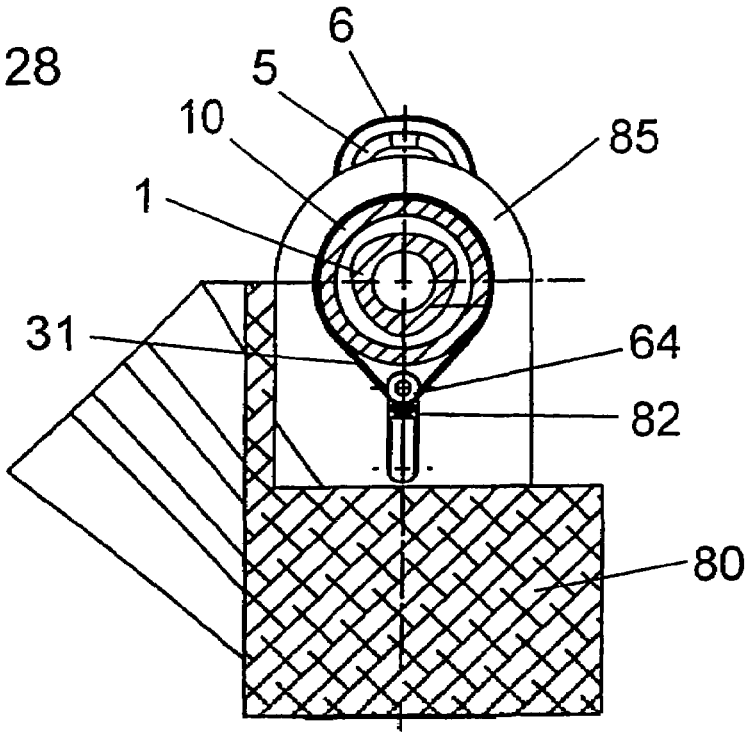
FIG. 28 shows a section according to the line XXVIII—XXVIII of FIG. 26.
Figure 29:
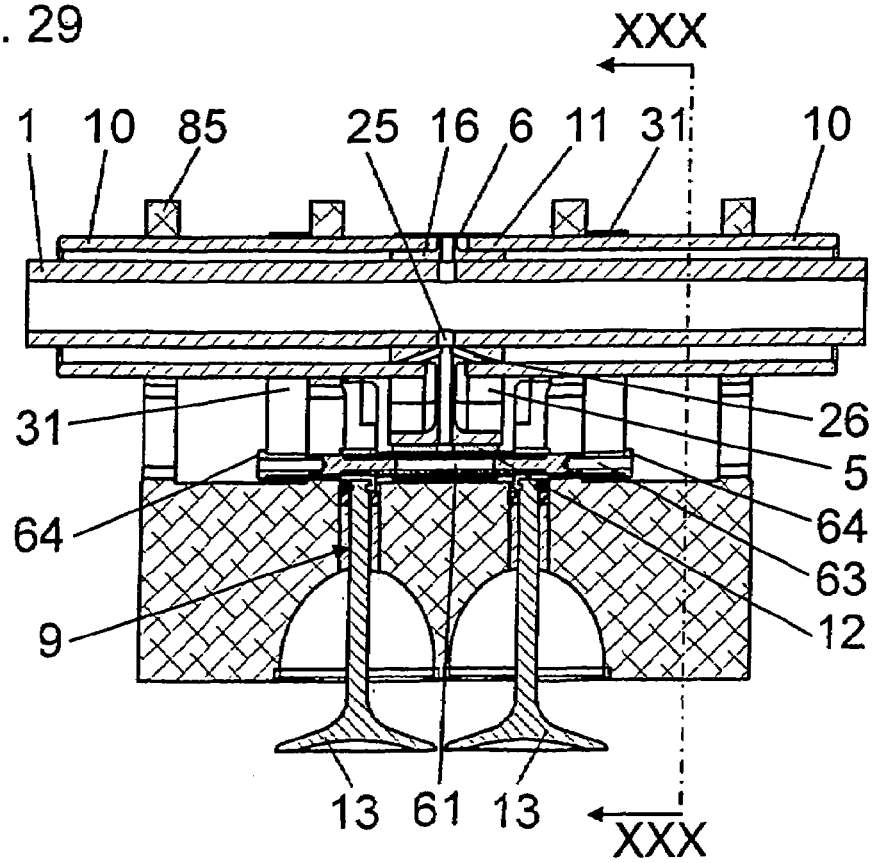
FIG. 29 shows a longitudinal section similar to FIG. 26, in which the cam follower element is rotated through 180°.
Figure 30:
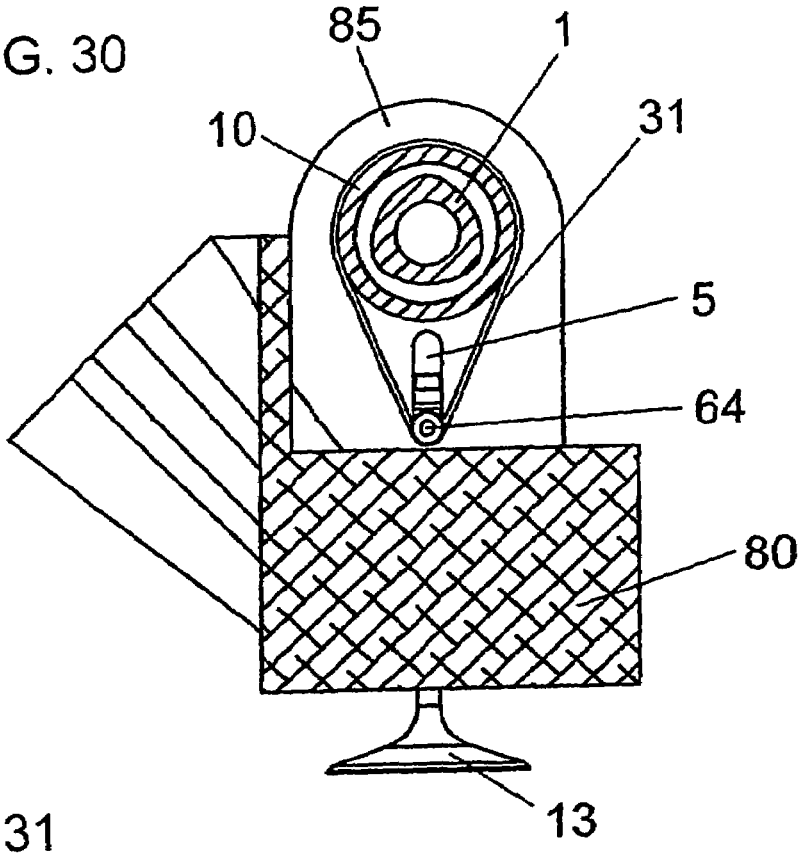
FIG. 30 shows a section according to the line XXX—XXX of FIG. 29.
Figure 31:
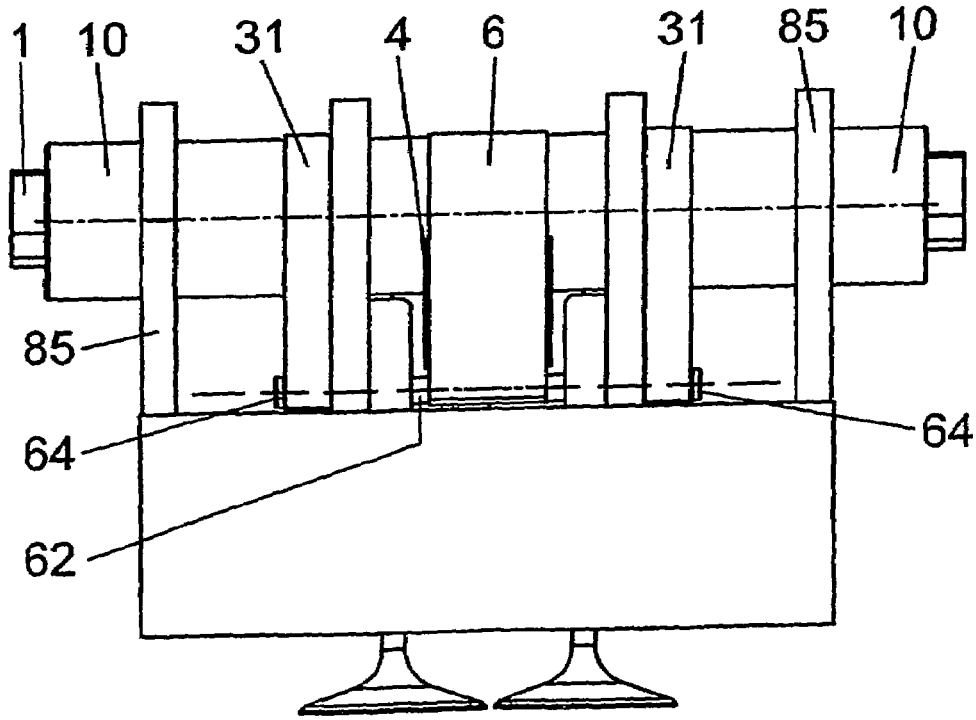
FIG. 31 shows a side view of the sixth embodiment.

An extended bearing pin 62 is inserted into the holder 12 of the enclosing element 6 and a tappet head 61 of a cam follower element 9 is mounted rotatably on both sides of it, in a manner similar to the embodiment according to FIG. 17. The ends 63 of the bearing pin 62 protrude in each case through a slot 82 in the bearing rings 85 and are pressed in the protruding part against the bearing sleeves 10 by a rubber band, a spring steel clip or another elastic element 31. The lateral slipping of the element 31 is prevented by a collar 64 (FIG. 27). As the comparison of FIGS. 26 and 29 and also 28 and 30 shows, the elastic elements 31 are expanded by the cam element 5 during the downward movement of the cam follower elements 9, i.e. during the opening of the valves, and produce a force which assists the return and which may be advantageous in many applications. Substantially stronger restoring springs which engage directly on the cam follower elements 9 are rendered superfluous by the constrained guidance of the enclosing element 6. Instead of the strip which is shown, other spring devices, for example leg springs or the like, may also be provided.

Figure 25:
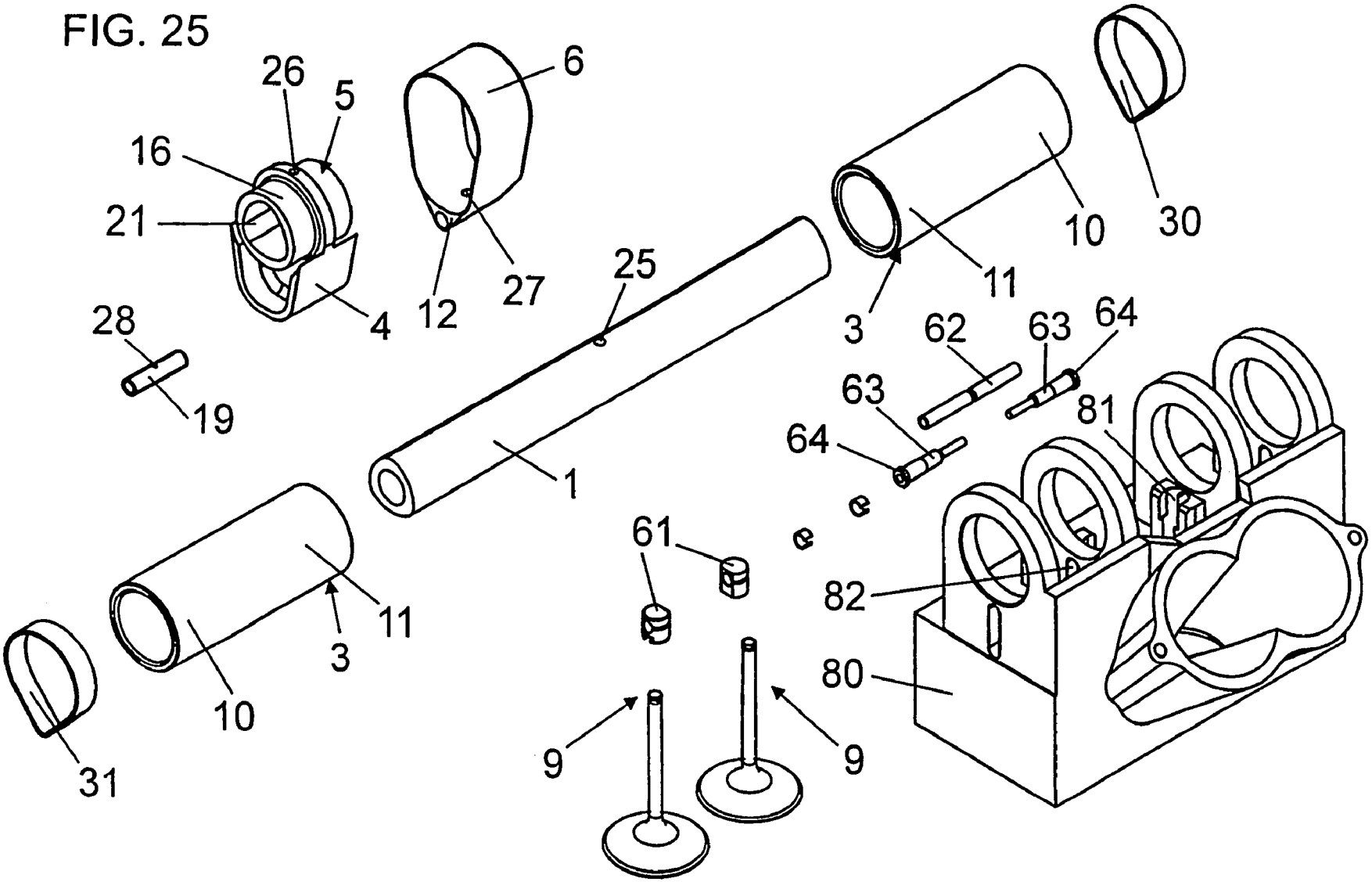
FIG. 25 shows an exploded illustration of the individual components of a sixth embodiment of the device according to the invention.
Figure 26:
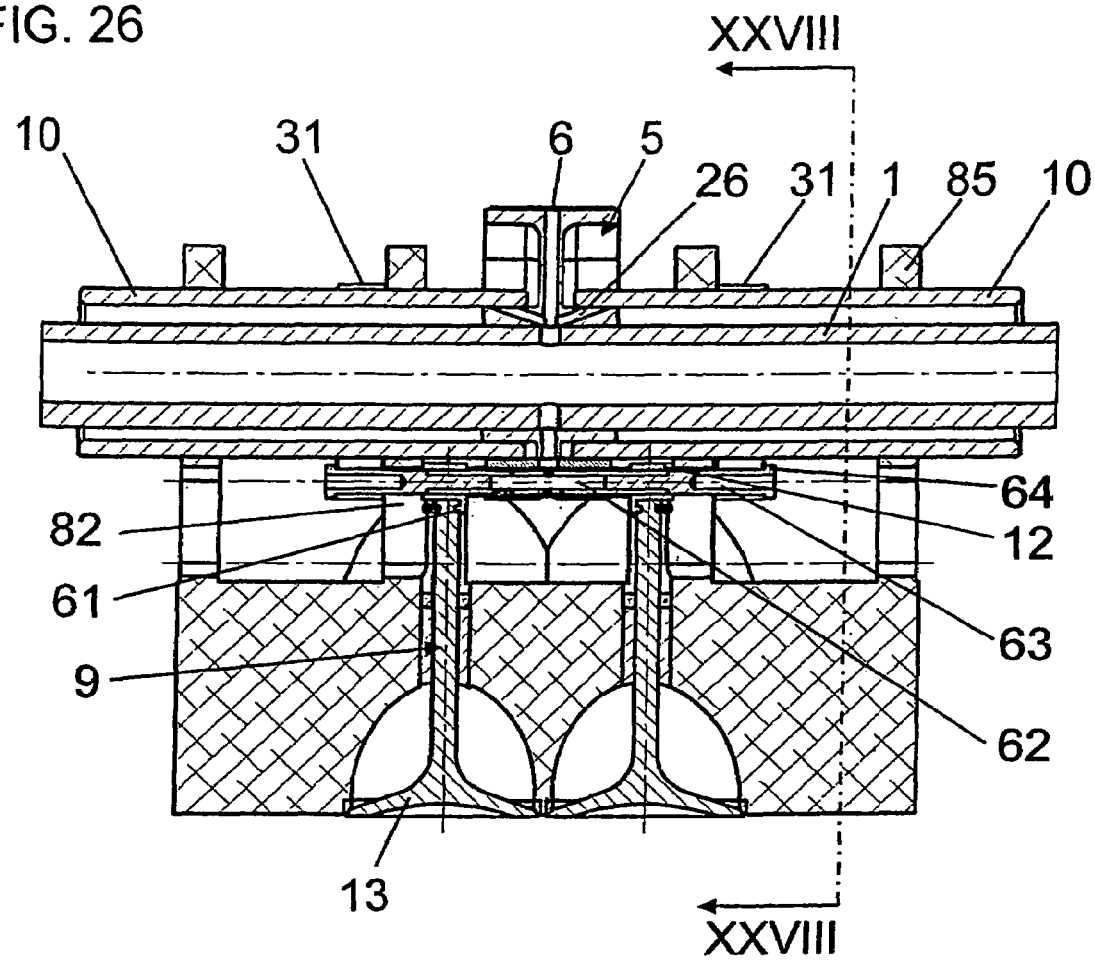
FIG. 26 shows a longitudinal section through the sixth embodiment, the cam follower element bearing against the bearing surface.

It is apparent in particular from FIGS. 25 and 27 that the tappet head 61 has an undercut insertion groove for the tappet of the cam follower element 9. Said element can be inserted from the side and is thereby mounted rotatably in the tappet head 61.

FIGS. 32 to 40 show embodiments which permit the cam stroke to be adjusted, and can therefore be used especially as a variable valve operating mechanism.

Figure 32:
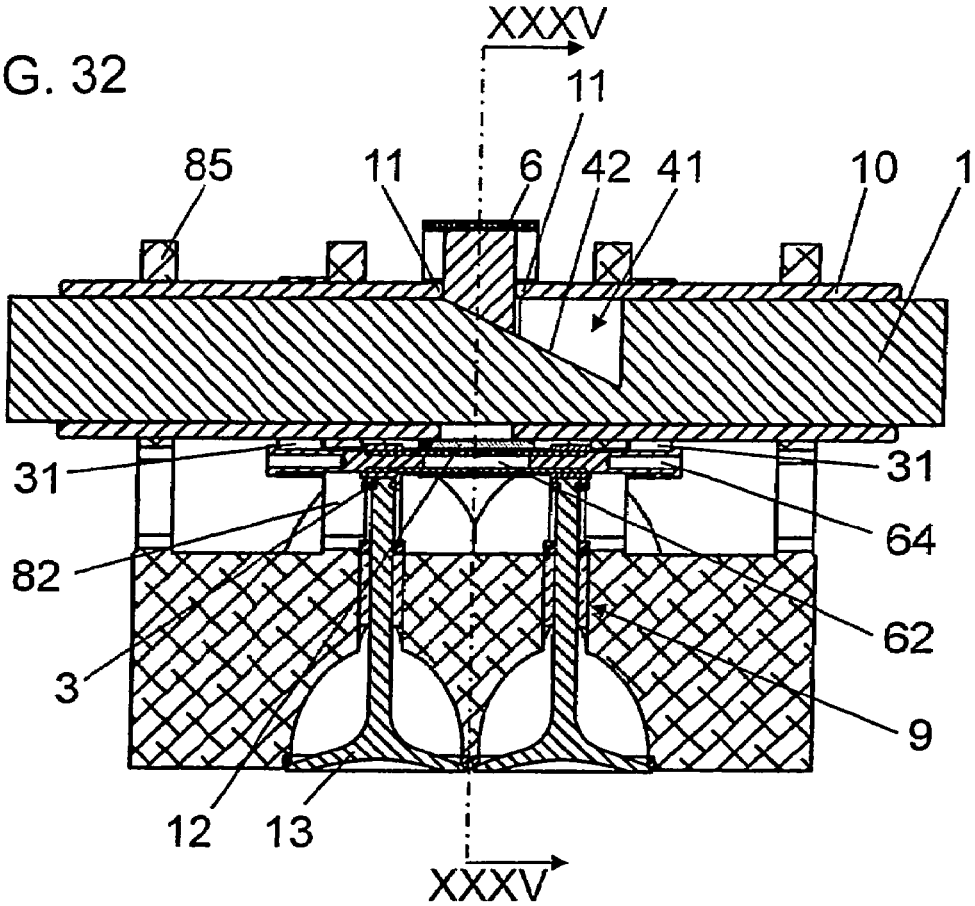
FIGS. 32 and 33 show longitudinal sections through a seventh embodiment of the device according to the invention, the cam follower element bearing in each case against the bearing surface.
Figure 33:
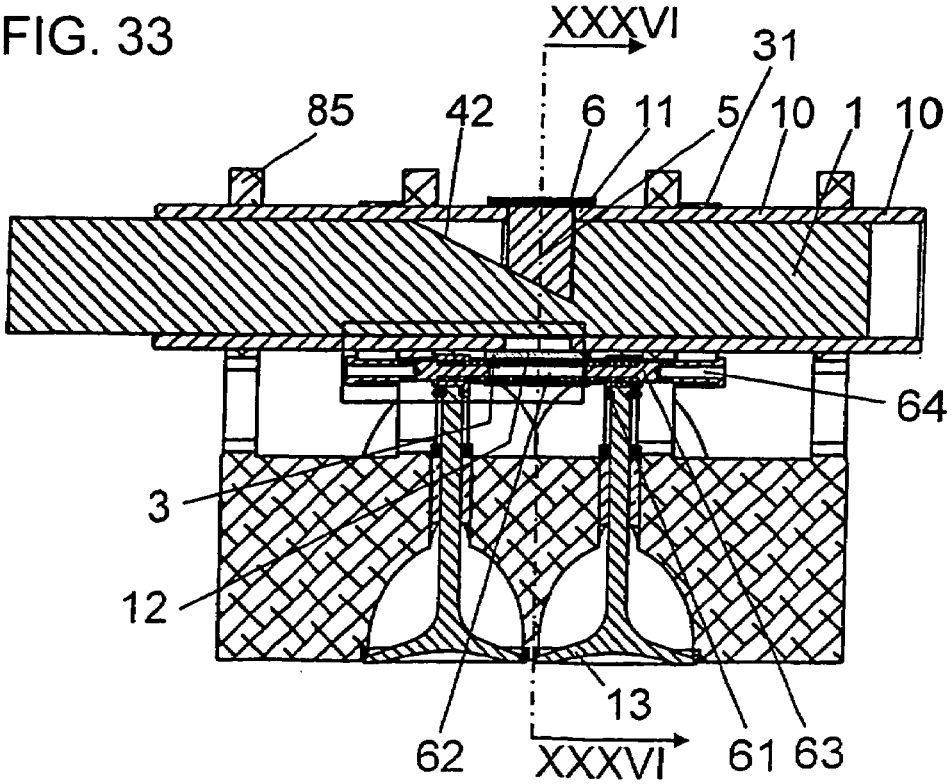
Figure 34:
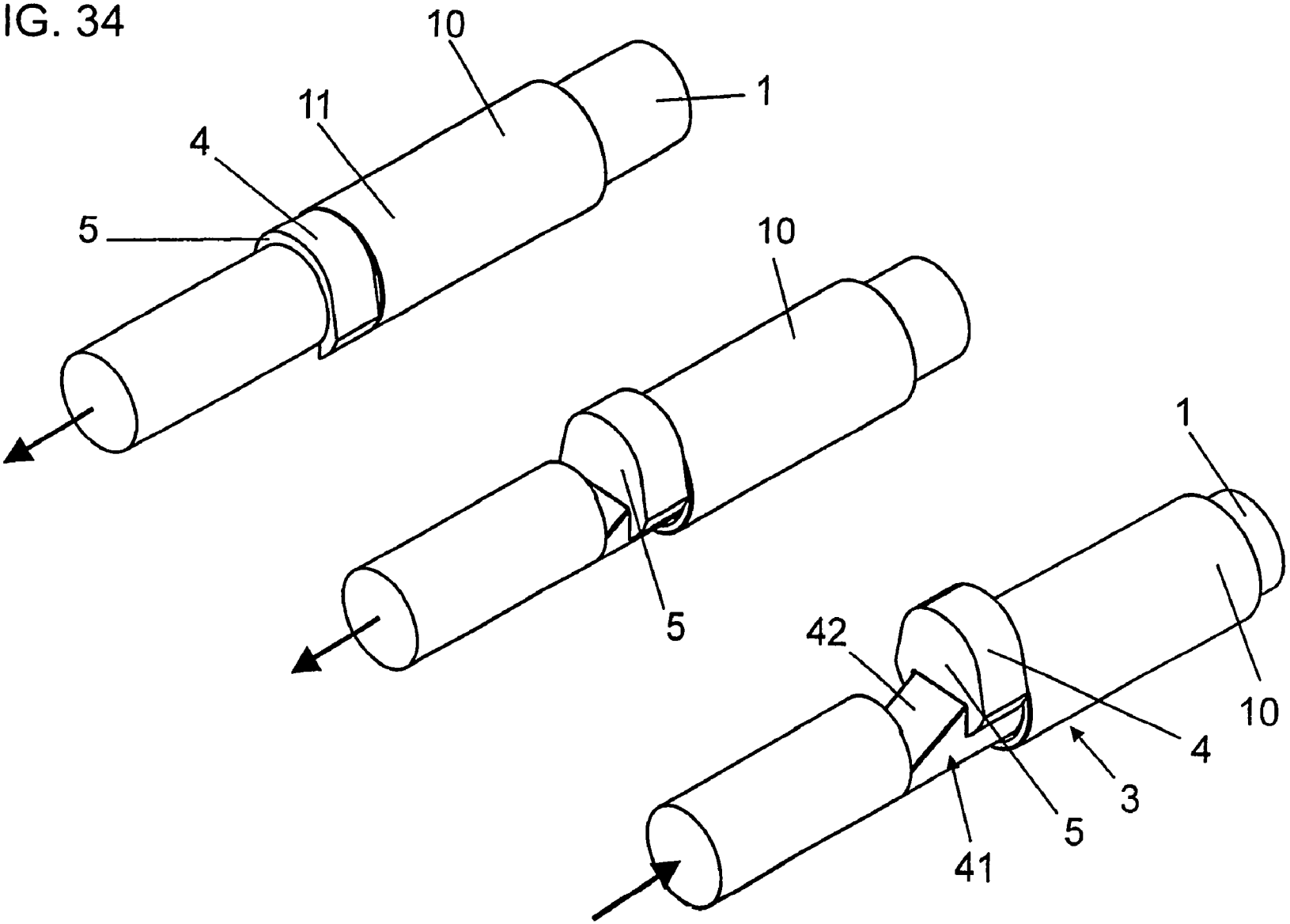
FIG. 34 shows oblique views of the support shaft and of the cam element in three different positions.
Figure 35:
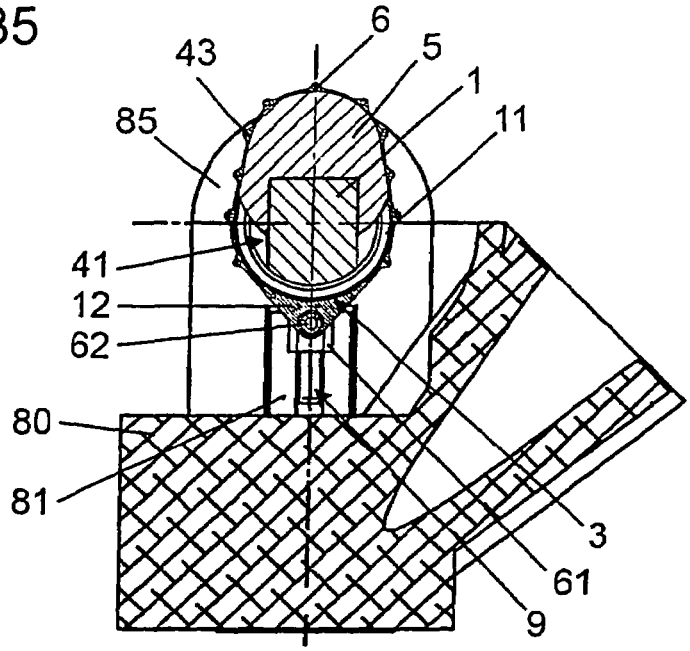
FIGS. 35 and 36 show sections according to the line XXXV—XXXV of FIG. 32 and the line XXXVI—XXXVI of FIG. 33.
Figure 36:
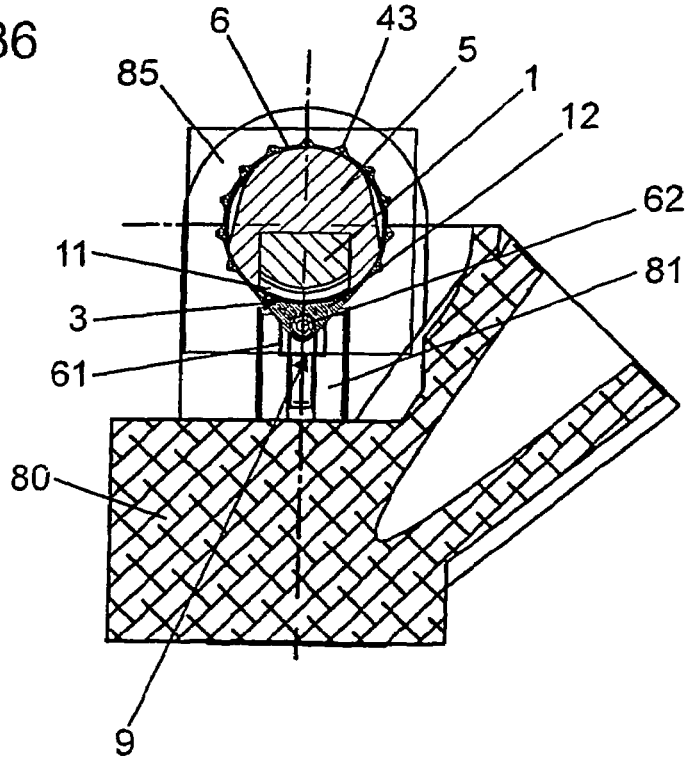

In the embodiment according to FIGS. 32 to 36, the support shaft 1 is arranged in a longitudinally displaceable manner in the bearing elements 10 and has, in each region in which a cam follower element 9 is to be actuated, a cutout 41 which is provided with an oblique surface 42, which rises in the longitudinal direction, and with lateral, parallel flattened sections. A cam element 5 which has an approximately U-shaped cutout on the side lying opposite the eccentric control surface 4 is guided on the parallel flattened sections in a manner enabling it to be pushed out and pushed in vertically. FIGS. 34 and 36 clearly show that the cam element 5, which does not protrude beyond the circumference of the bearing element 10 in a lowest position, is raised, when the support shaft 1 is displaced to the left, by the oblique surface 42, which rises in a wedge-shaped manner, and are transferred into the position which is shown at the bottom in FIG. 34 and in FIG. 35 and in which it is extended to the maximum.

The rest of the structural design corresponds essentially to that of FIG. 25, and so these details do not have to be repeated here. Only the enclosing element 6 is of elastically expandable design, since it has to be lengthened and shortened, as is apparent in particular from the comparison of FIGS. 35 and 36.

An enclosing element 6 which can be lengthened reversibly has already been described by me in my above-mentioned earlier PCT publication WO 01/12959 A, and its substantially corresponding U.S. Patent application publication US 2002/0185092 A1, which are herewith incorporated by reference. The enclosing element 6 is, for example, a seamless loop which is produced from threads or fibers in a textile circular working technique. The enclosing element preferably has threads made from an extension-resistant material which extend in the circumferential direction and form an elongation limit. A fabric-loop may be provided with a friction-reducing coating at least in each case in the region of the inwardly protruding bumps which are formed by the intersecting threads.

The elastic enclosing element 6 can render the elastic elements 31 shown in FIGS. 32 and 33 superfluous, since it likewise exerts a restoring force on the bearing pin 62. Owing to the elasticity of the enclosing element 6, it may be advantageous if it contains stiffenings in the transverse direction, i.e. in the axial direction of the support shaft, for example in the form of reinforcing ribs 43 which have pins inserted or bonded into them. The transverse stiffenings prevent unsupported parts of the enclosing element 6 from being pulled in in the region of the cam element 5.

Figure 37:
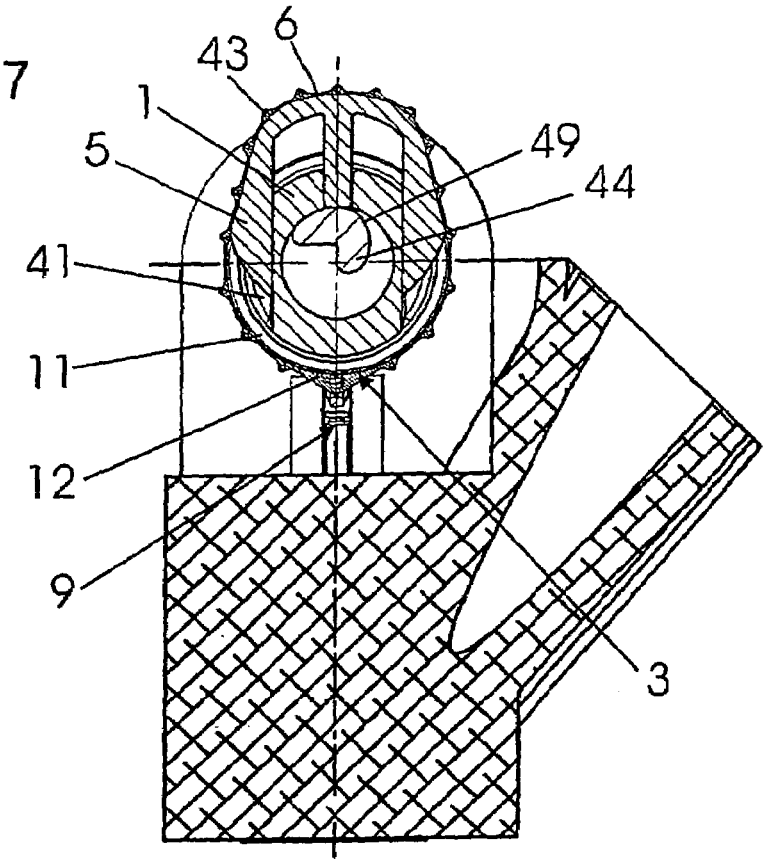
FIGS. 37 and 38 show sections through an eighth embodiment of the device according to the invention, the cam follower element bearing in each case against the bearing surface.
Figure 38:
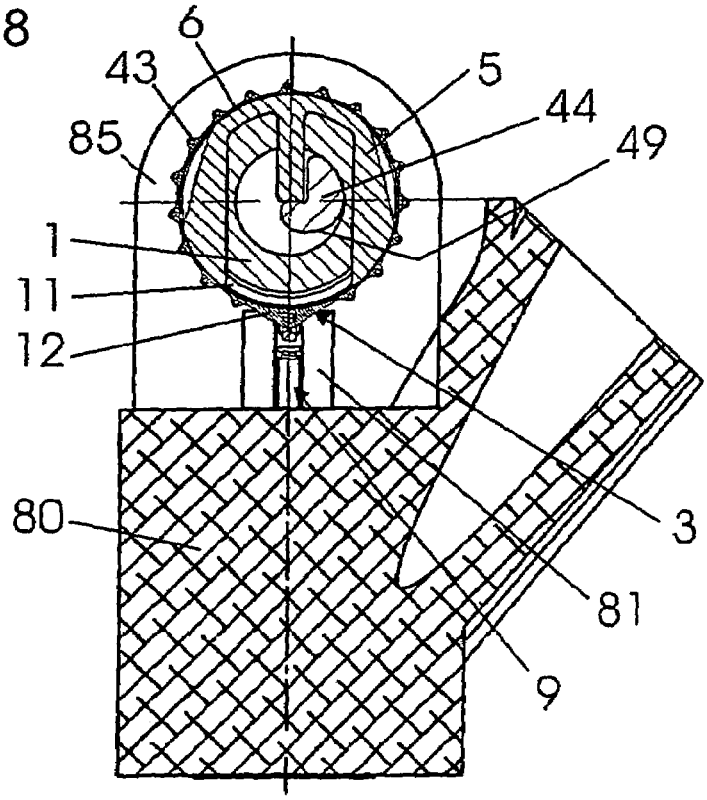

In the embodiment according to FIGS. 37 and 38, a rotatable control shaft 44 is arranged in the support shaft 1 for the radial movement of the cam element 5 and has an eccentric, spirally rising control surface 49 formed on it. From the comparison of the two FIGS. 37 and 38, the adjustment sequence of the cam element 5 can be seen. The cam element 5 is held in the hook-like core region of the control shaft 34 in the pushed-out position according to FIG. 37. If the control shaft 34 is rotated anticlockwise in the support shaft 31, then the cam element 5, which bears against the spiral-shaped control surface 49, migrates inward until the position without any lift according to FIG. 38 is reached. In this position, the cam element 5 is situated within the cylindrical outer surface of the bearing element 10 or the annular region 11 of the bearing element 10, so that the gathered enclosing element 6 bears all around the annular region 11 and all friction is avoided since the cam element 5 revolves without any contact.

Figure 39:
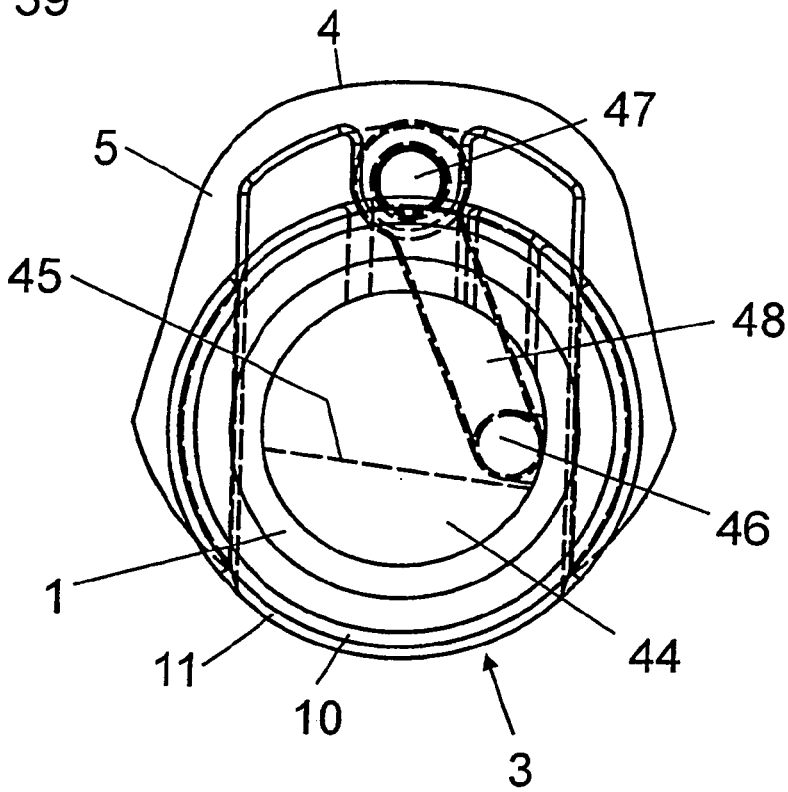
FIGS. 39 and 40 show schematic end views of a cam element guided in a constrained manner by means of a crank mechanism, in two different positions.
Figure 40:
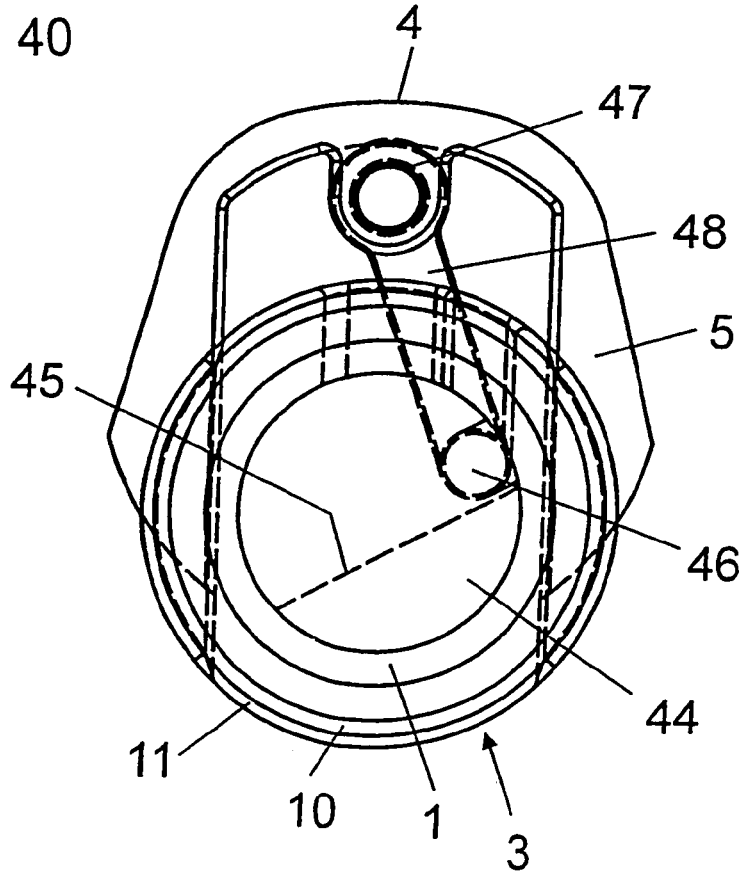

FIGS. 39 and 40 show an embodiment in which the cam element 5 is extended and retracted while being guided in a constrained manner. A control shaft 44 in the interior of the support shaft 1 has a slot 45 in which a link 48 is mounted rotatably on a bearing pin 46. The second end of the link 48 is arranged on a bearing pin 47 which is mounted in the interior of the cam element 5, the cam element 5 being of approximately U-shaped design and being arranged in a guide of the support shaft 1, or in a guide sleeve arranged on the support shaft 1, in a manner such that it can be pushed out and in. The constrained guide therefore constitutes a crank mechanism which can be rotated over an angle of approximately 120°. FIG. 39 shows a partial stroke and FIG. 40 the full stroke of the cam element 5.

In the embodiments according to FIGS. 32 to 40, the enclosing element 6 forms on both sides a rectilinear bridging of the transition region between the nonrotatable bearing surface 3 and the eccentric control surface 4 which changes as the stroke changes. Furthermore, the embodiments according to FIGS. 32 to 40 can also be used for adjusting the stroke of the cam element 5 if the bearing surface 3 is provided on the driven support shaft 1 or on a part rotating at the same time as the support shaft.

I claim:

1. A device for converting a rotational movement into a reciprocating movement, comprising:

at least one cam element mounted on a driven support shaft for rotation about an axis of rotation, said cam element having an eccentric control surface driven by said support shaft;

a cam follower element mounted for displacement or pivoting by said cam element and for bearing on a non-driven bearing surface;

a flexible enclosing element connected to said cam follower element, said flexible enclosing element enclosing said cam element while allowing said cam element to rotate therein and moving said flexible enclosing element in a plane perpendicular to said axis of rotation of said cam element, and said flexible enclosing element surrounding said non-driven bearing surface for said cam follower element.

2. The device according to claim 1 configured as a cam control device.

3. The device according to claim 1, wherein said cam follower element is a valve tappet for a valve in an internal combustion engine of a motor vehicle.

4. The device according to claim 1, wherein said non-driven bearing surface is formed on a bearing element of said support shaft, said bearing element rotatably mounted relative to at least one of said support shaft and said cam element.

5. The device according to claim 4, wherein said bearing element has an annular end region, and said cam element has a central part mounted inside said annular end region.

6. The device according to claim 1, which further comprises a roller bearing disposed between said bearing element and at least one of said support shaft and said cam element.

7. The device according to claim 1, which comprises a relatively stationary guide, and wherein an end of said cam follower element connected to said enclosing element is guided in said guide.

8. The device according to claim 1, which comprises a roller bearing disposed in said eccentric control surface of said cam element.

9. The device according to claim 8, wherein said roller bearing includes at least one rotatably mounted roller.

10. The device according to claim 8, wherein said support shaft and said cam element are formed with feed ducts for feeding a friction-reducing medium to said bearing surfaces of said roller bearing and to said eccentric control surface.

11. The device according to claim 1, wherein said support shaft and said cam element are formed with feed ducts for feeding a friction-reducing medium to said eccentric control surface.

12. The device according to claim 1, which comprises a bearing pin articulating said cam follower element to said enclosing element, and an elastic element biasing said bearing pin against said bearing surface, and wherein said bearing surface is fixed on the device.

13. The device according to claim 12, wherein said bearing pin is formed with at least one exposed end region, and an elastically flexible strip is guided around said exposed end region and said bearing element.

14. The device according to claim 13, wherein said flexible strip is formed of a material selected from the group consisting of steel and rubber.

15. The device according to claim 1, wherein said cam element is disposed on said support shaft to be radially extendable and retractable, and said enclosing element is an elastic element.

16. The device according to claim 15, which comprises rising control surfaces formed between said radially extendable and retractable cam element and said support shaft.

17. The device according to claim 15, which comprises a control shaft movably disposed in said support shaft, and rising control surfaces formed between said radially extendable and retractable cam element and said control shaft.

18. The device according to claim 15, wherein said radially extendable and retractable cam element is guided in a constrained manner.

19. A device for converting a rotational movement into a reciprocating movement, comprising:

a driven support shaft mounted for rotation about an axis of rotation;

a cam element mounted on said driven support shaft, said cam element having an eccentric control surface;

a non-driven bearing surface mounted on said driven support shaft;

a cam follower element mounted for displacement or pivoting by said cam element;

a flexible enclosing element connected to said cam follower element and surrounding said cam element and said non-driven bearing surface;

said flexible enclosing element flexibly moving in a radial direction relative to said axis of rotation as said cam element rotates therein, following said eccentric control surface and bearing against said non-driven bearing surface.

* * * * *